US008079104B2

(12) United States Patent
Presnell et al.

(10) Patent No.: US 8,079,104 B2
(45) Date of Patent: Dec. 20, 2011

(54) CHANGING STATION

(75) Inventors: Donald C. Presnell, Stephens City, VA (US); Kevin Fitzpatrick, Winchester, VA (US)

(73) Assignee: Rubbermaid Commercial Products/US, Winchester, VA (US)

( * ) Notice: Subject to any disclaimer, the term of this patent is extended or adjusted under 35 U.S.C. 154(b) by 0 days.

(21) Appl. No.: 13/027,808

(22) Filed: Feb. 15, 2011

(65) Prior Publication Data

US 2011/0131730 A1 Jun. 9, 2011

Related U.S. Application Data

(63) Continuation of application No. 12/040,311, filed on Feb. 29, 2008.

(60) Provisional application No. 60/892,717, filed on Mar. 2, 2007, provisional application No. 60/938,919, filed on May 18, 2007.

(51) Int. Cl.
*A47C 16/00* (2006.01)

(52) U.S. Cl. ..... 5/655; 5/947

(58) Field of Classification Search ..... 5/93.1, 5/133, 136, 139, 655, 947, 167, 118, 9.1; 108/42, 46, 47, 35, 38, 152, 134, 135; 211/88.01, 211/90.02, 96, 104, 150; 248/289.11, 240, 248/235, 236, 240.1, 250; 312/248, 313; 297/235, 236, 240, 240.1, 250, 378.1
See application file for complete search history.

(56) References Cited

U.S. PATENT DOCUMENTS

| | | | |
|---|---|---|---|
| 4,234,977 | A | 11/1980 | Snow |
| 4,573,608 | A | 3/1986 | Hansen |
| 5,754,999 | A | 5/1998 | Helmsderfer |
| 5,906,015 | A | 5/1999 | Hilger et al. |
| 5,950,627 | A | 9/1999 | Bologovsky et al. |
| 6,032,310 | A | 3/2000 | Helmsderfer et al. |
| 6,049,928 | A | 4/2000 | Helmsderfer |
| 6,151,737 | A | 11/2000 | Henninge |
| 6,269,503 | B1 | 8/2001 | Betker |
| D620,724 | S | 8/2010 | Presnell |
| 2008/0209635 | A1 | 9/2008 | Gonzalez et al. |

FOREIGN PATENT DOCUMENTS

| | | | |
|---|---|---|---|
| DE | 197 53 63 | U | 12/1967 |
| JP | 11-299592 | A | 11/1999 |
| JP | 2002-000410 | A | 1/2002 |
| JP | 2003-052494 | A | 2/2003 |
| JP | 2005-143635 | A | 6/2005 |
| WO | WO-00/26100 | A1 | 5/2000 |

OTHER PUBLICATIONS

International Search Report for Application No. PCT/US2008/055504, dated Sep. 3, 2008.

*Primary Examiner* — Peter M Cuomo
*Assistant Examiner* — Nicholas Polito
(74) *Attorney, Agent, or Firm* — Marshall, Gerstein & Borun LLP

(57) ABSTRACT

The disclosed changing station may support a small person, such as a baby. The station may comprise a platform, a support structure, and a mounting structure. The platform may be rotatable from a vertical storage position to a horizontal use position along a rotational axis. The support structure may have a rotatable support member that rotates along the rotational axis. The mounting structure may be used for mounting the support structure to a vertical wall.

7 Claims, 31 Drawing Sheets

CHANGING STATION

CROSS-REFERENCE TO RELATED PATENT APPLICATIONS

This is a Continuation of U.S. Non-Provisional application Ser. No. 12/040,311 (filed Feb. 29, 2008), which claims priority to U.S. Priority Provisional Application Nos. 60/892,717 (filed Mar. 2, 2007) and 60/938,919 (filed May 18, 2007), all aforementioned applications including the specifications, drawings, claims and abstracts, hereby being incorporated herein by reference in their entireties.

BACKGROUND

Baby changing stations are tables found in public restrooms for use by the public. When a parent or caretaker needs to change a baby's diaper, these stations provide a convenient surface where a baby may be placed during the diaper change.

SUMMARY OF THE INVENTION

According to one embodiment of the present invention, a changing station for supporting a small person, may comprise: a platform that is rotatable from a vertical storage position to a horizontal use position along a rotational axis; a support structure having a rotatable support member that rotates along the rotational axis; a mounting structure for mounting the support structure to a vertical wall; and at least one hanging member located on the mounting structure such that the hanging member is spaced at a vertical distance from the platform when the platform is in the horizontal position.

According to another embodiment of the present invention, a changing station for supporting a small person, may comprise: a platform that is rotatable from a vertical storage position to a horizontal use position along a rotational axis; a support structure having a rotatable steel support member that rotates along the rotational axis and at least one steel extending member that extends out at an angle from the support member for supporting the platform; and a mounting structure for mounting the support structure to a vertical wall. The rotatable support member and that at least one extending member may be formed from steel.

According to another embodiment of the present invention, a changing station for supporting a small person may comprise: a platform that is rotatable from a vertical storage position to a horizontal use position along a rotational axis; a support structure having a rotatable support member that rotates along the rotational axis; a mounting structure for mounting the support structure to a vertical wall; and at least one damper system configured to slow the rotation of the platform when the platform moves from the vertical position to the horizontal position.

It is to be understood that both the foregoing general description and the following detailed description are exemplary and explanatory only, and are not restrictive of the invention as claimed.

BRIEF DESCRIPTION OF THE DRAWINGS

The features, aspects, and advantages of the present invention will become apparent from the following description, appended claims, and the accompanying exemplary embodiments shown in the drawings, which are briefly described below.

DETAILED DESCRIPTION

The changing stations according to embodiments of the present invention may be used as wall-mounted baby diaper changing tables for commercial use. Such baby changing stations may be used in public restrooms or any other suitable location. When a parent or caretaker needs to change a baby's diaper, they may enter the restroom and unfold the changing table down to a horizontal use position so that the baby can be placed on the changing platform, table, or bed, for diaper changing. The station may be mounted on a wall such that the station does not interfere with other restroom traffic when the station is not in use while in a folded configuration. Baby changing stations can have two formats: 1) a wall-mounted vertical configuration and 2) a wall-mounted horizontal configuration. Both configurations are contemplated to be within the scope of the present invention.

Figure 1:
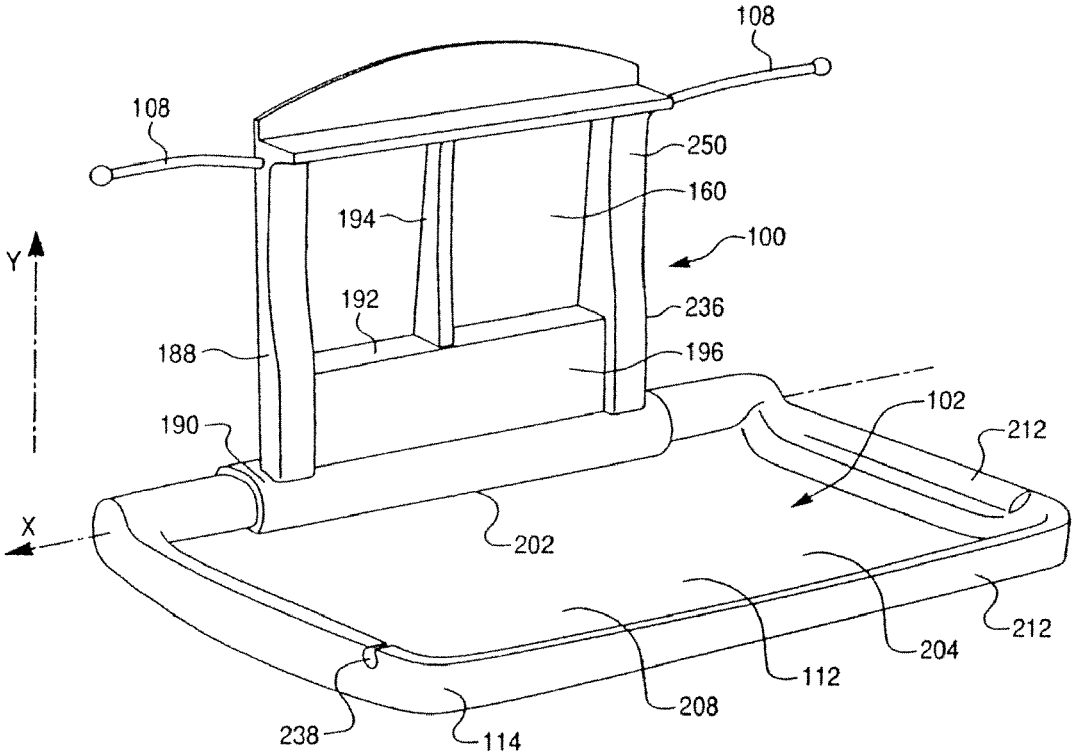
FIG. 1 is a frontal perspective view of a changing station according to an embodiment of the present invention in a horizontal use position.
Figure 2:
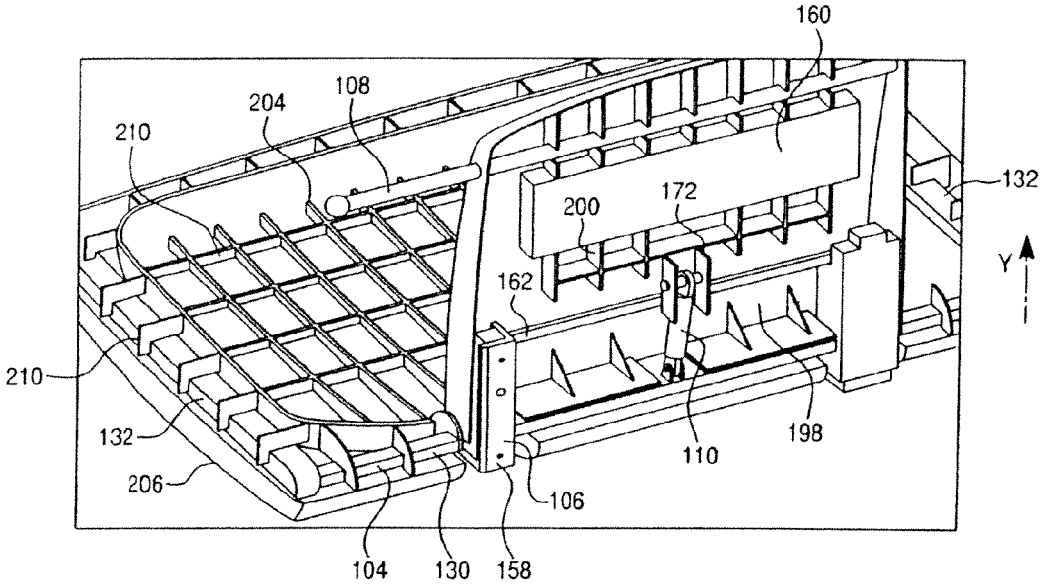
FIG. 2 is a rear perspective view of the changing station of FIG. 1 with the top surface of the platform being translucent.

FIGS. 1 and 2 show components of a baby changing station 100 for supporting a baby according to an embodiment of the present invention. The baby changing station 100 may comprise a platform 102, a support structure 104, a mounting structure 106, at least one hanging member 108, and a damper system 110.

Figure 3A:
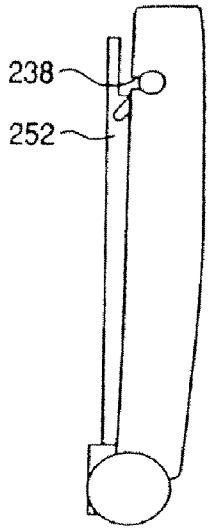
FIGS. 3A and 3B are side and frontal perspective views of the changing station of FIG. 1 in a vertical storage position.
Figure 3B:
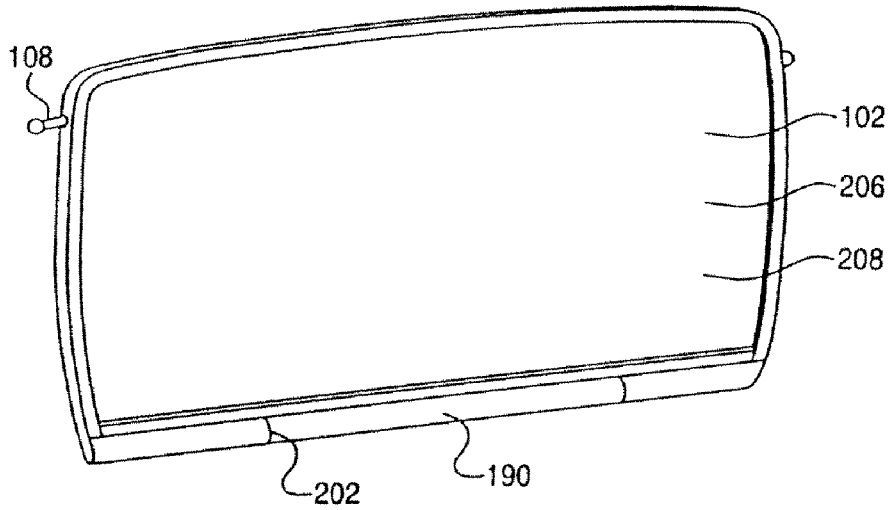

The platform 102 can be rotatable from a vertical storage position, as seen in FIGS. 3A and 3B, to a horizontal use position, as seen in FIG. 1, along a rotational axis X. The platform 102 can be supported in the horizontal use position by one or more members of the support structure 104. The platform may be made of any suitable material. For example, the platform may be formed from polypropylene plastic using high-pressure injection molding technology. Although the use of plastics or other engineering resins is preferred, the platform 102 may be made out of aluminum, stainless steel or some other non-corrosive metal alloy but the surface of the platform 102 preferably is cleanable, using typical disinfectant cleaning chemicals. In addition, wooden or organic materials may also be used in the formation of the platform.

The most preferred embodiment of the platform 102 is one in which the platform is formed from a plastic resin with anti-microbial additives embedded in the plastic resin. The use of anti-microbial additives on the work surface 112 of the platform can prevent or inhibit bacterial growth and may ease the worries of parents concerned about the cleanliness of the baby changing station.

If plastic (with or without anti-microbial additives) is used as the material for the platform 102, the work surface 112 of the platform 102 preferably should be smooth or at least lightly textured so that it is easily cleaned. The platform could have corners 114 with large radii to protect the user against injury. Also, if the corners and crevices are smooth, there is less of an opportunity for bacteria to grow. In a preferred embodiment, the platform 102 is formed so that there are few spots where bacteria can hide, and to make cleaning and disinfecting the platform easier. Furthermore, the platform may include sidewalls 212 around the periphery of the work surface 112 so as to aid in retaining the baby on the work surface.

Overall, the platform 102 can include a top portion 204 and a bottom portion 206, which encapsulate the support structure 104. The top portion 204 includes an outer surface 208, which includes the work surface 112, and an inner surface. Likewise, the bottom portion includes an outer surface 208 and an inner surface. The outer surfaces of the top and bottom portions preferably are smooth so as to be aesthetically pleasing and to reduce places for bacteria to grow. The inner surfaces of the top and bottom portions can contain a plurality of ribs 210 that can run in a suitable pattern to accommodate the support structure 104 that is located within the platform and to provide strength to the work surface 112 so that the platform does not significantly deform under a work load.

Figure 4A:
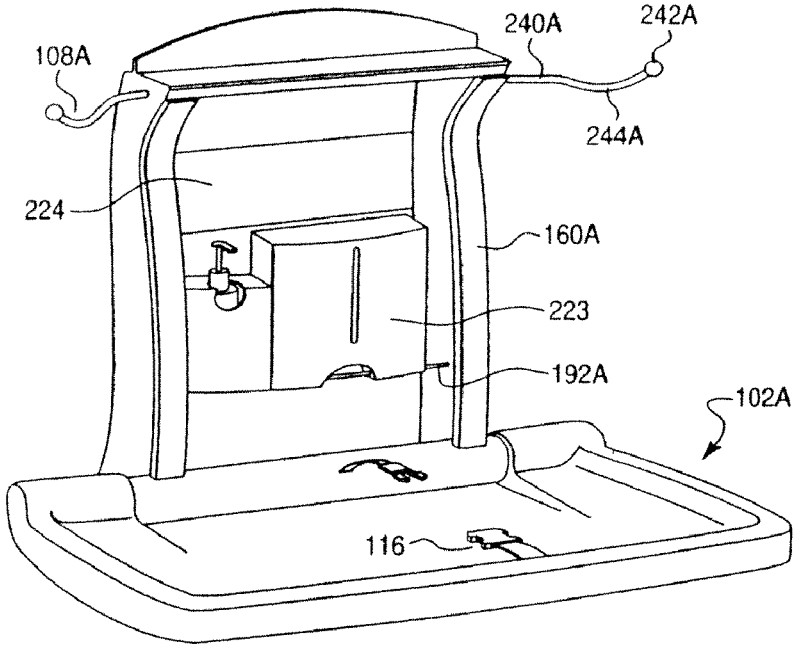
FIGS. 4A though 4J are frontal perspective views of various embodiments of the platforms and backboards used in the changing station.
Figure 4B:
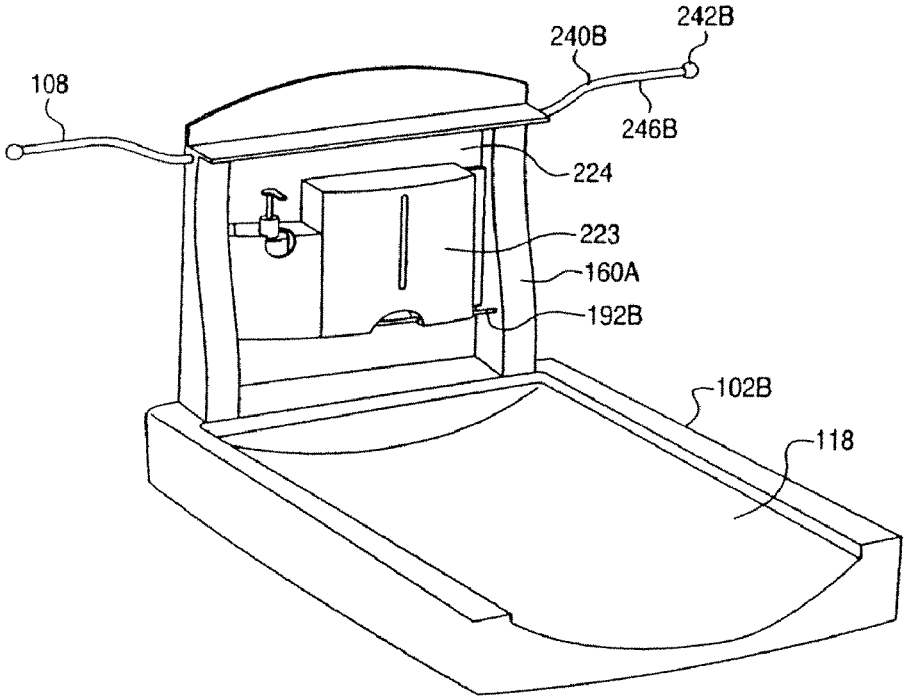

As can be seen in FIG. 1, this embodiment has a basic shape that is rectangular with rounded edges, having large radii on all inside corners and smooth surfaces for ease of cleaning and safety for the baby. Besides the embodiment shown in FIG. 1, the platform may take any desirable shape or configuration. For example, FIGS. 4A though 4J shows different platforms that may be used as the baby changing platform. The platform 102A of FIG. 4A is the same as the platform of FIG. 1 but includes safety straps 116 to secure the baby to the work surface (both embodiments of FIGS. 1 and 4A are of a horizontal configuration). The platform 102B of FIG. 4B includes a basin in which the baby is cradled, and the basin extends lengthwise through the wall in which the parent or caregiver stands. The platform of FIG. 4B is longer in the direction from the wall than in the direction along the wall (a vertical configuration), unlike the platforms of FIGS. 1 and 4A (horizontal configurations).

Figure 4C:
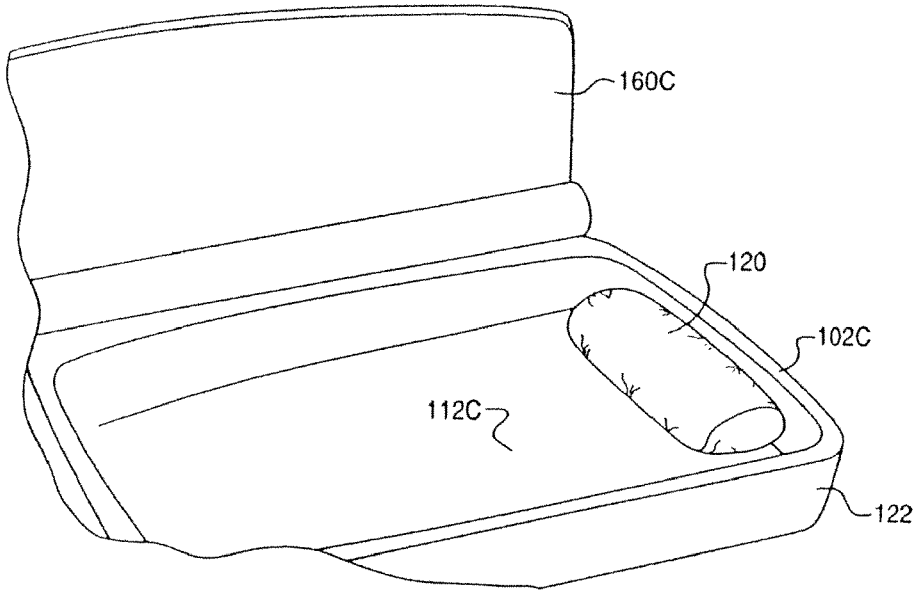
Figure 4D:
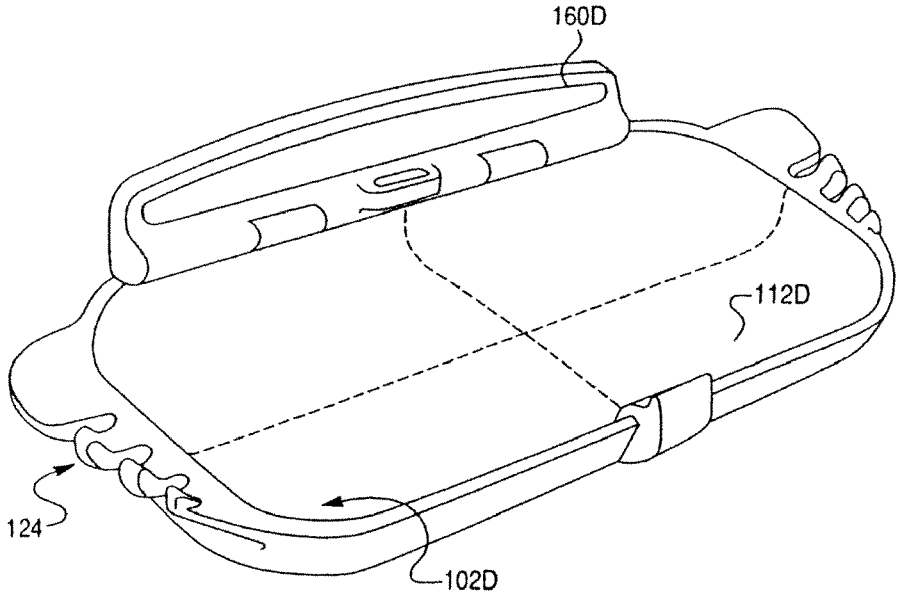
Figure 4E:
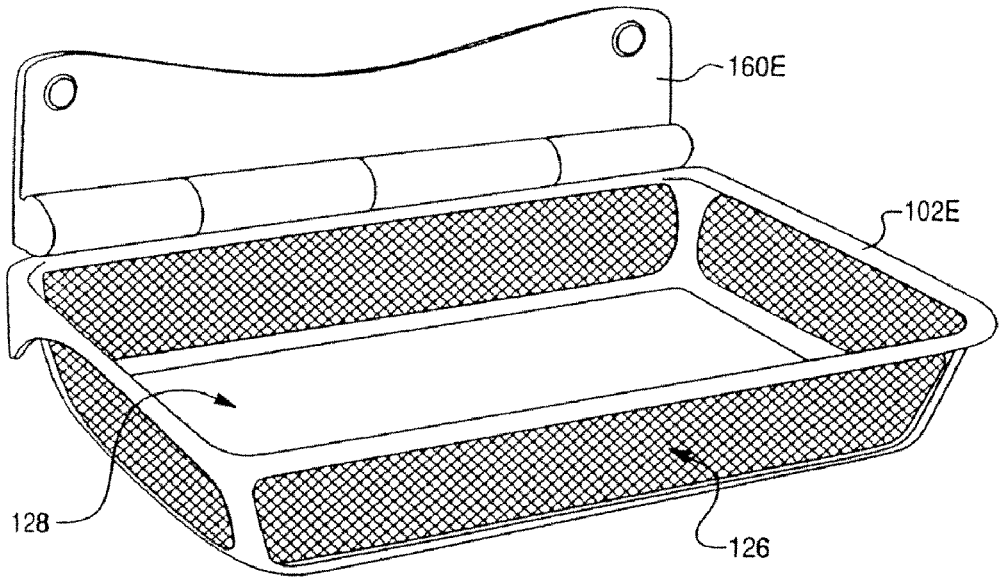
Figure 4F:
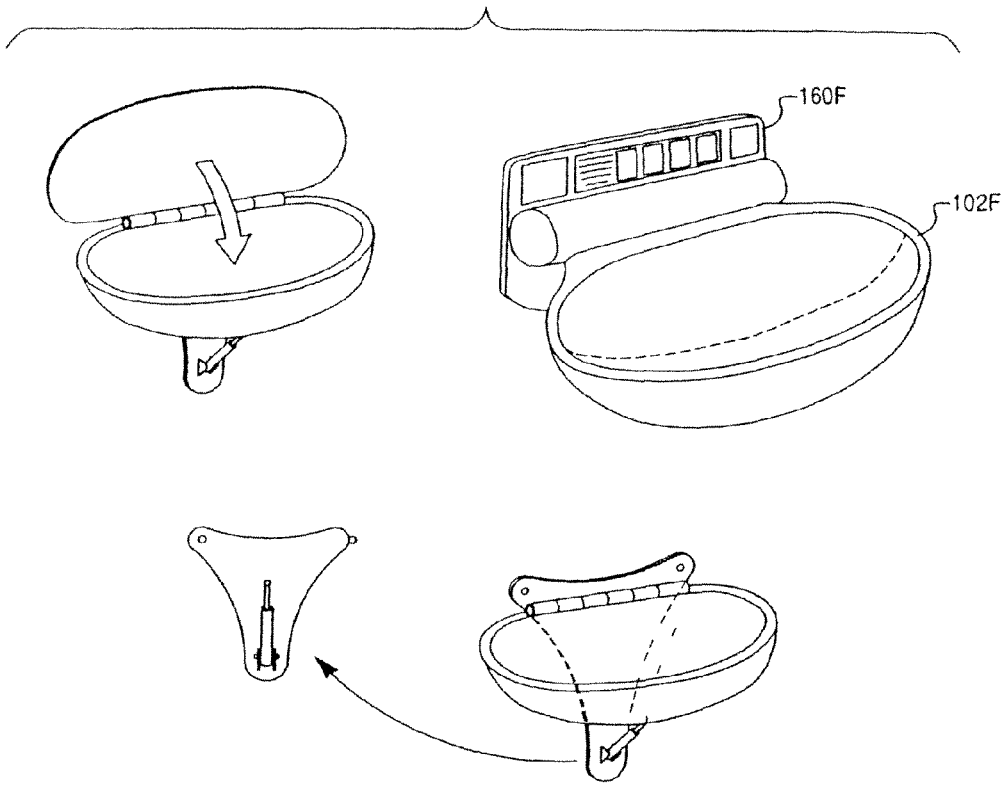
Figure 4G:
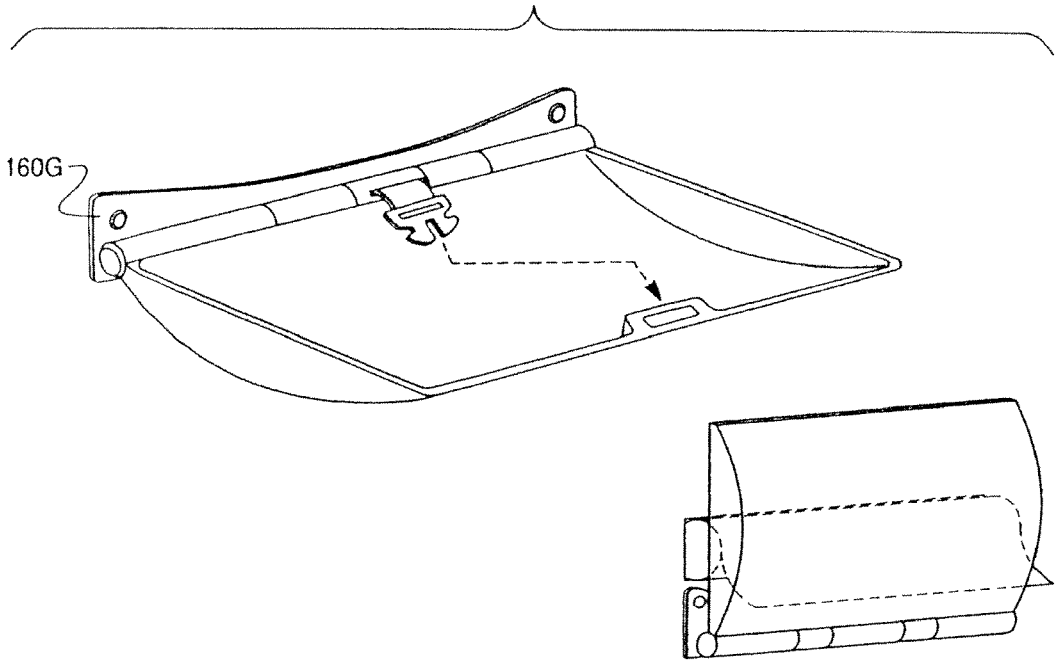
Figure 4H:
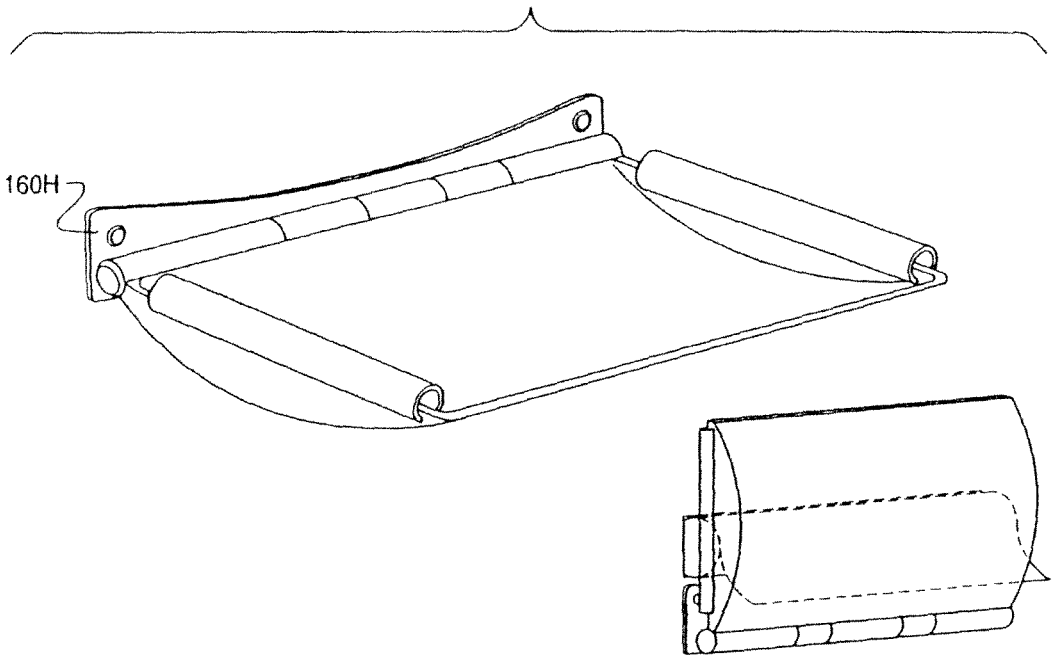
Figure 4I:
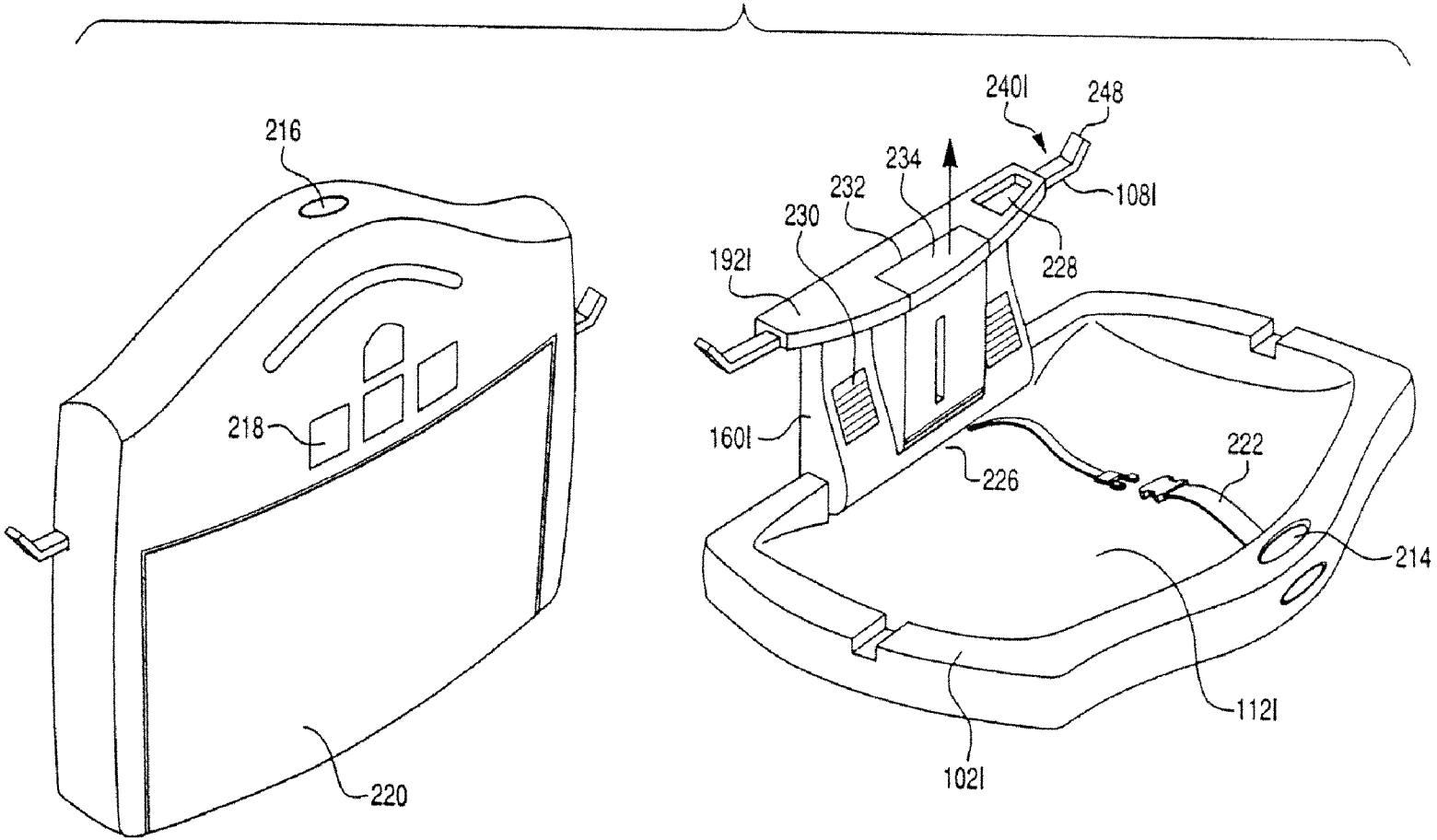

The platform 104C of FIG. 4C includes higher walls 122 around the periphery of the work surface 112C than the embodiment of FIG. 1, and includes a soft, cleanable, vinyl headrest 120. The platform 104D of FIG. 4D is a soft table with rounded corners and includes one or more hooks 124 for hanging diaper bags, purses, bags, or any other suitable carrier. The number of hooks may vary, for example there may be one, two, three, four or more hooks that may be on one, two, or three sides of the work surface 112D of the platform. The platform 102E of FIG. 4E has high mesh walls 126 and a work surface 128 that has a soft feel, which may be made of soft plastic. The platform 102F of FIG. 4F is in the form of a clam shell in which the baby is cradled therein. The platforms 102G and 102H of FIGS. 4G and 4H, respectfully, may be made from an all stainless steel construction, an all aluminum construction, an all plastic construction, or a combination thereof.

The platform 1021 of FIG. 41 includes safety straps 222 for securing the baby on the work surface 1121; a handle 214 to assist in moving the platform 1021 into the storage position; a handle 216 to assist in moving the platform 1021 into the use position; operational instructions 218 in the form of pictorials, text, or the like on decals, painted on, or the like; and a stainless steel or corrosion resistant metal plate 220 that is curved in one direction only. The platform 102J of FIG. 4J (a vertical configuration) includes safety straps 222 for securing the baby on the work surface and side walls along the work surface 112J to help retain the baby on the work surface. Also, the outer face 288 of the platform 102J could accept stainless steel facing so as to provide an up-scale appearance. Furthermore, a handle 284 is added to the outer face 288 of the platform 102J to permit the opening of the platform to the horizontal position with one hand.

Referring now to FIGS. 2 and 5A through 5C, the support structure 104 may have a rotatable support member 130 that rotates along the rotational axis X and at least one extending member 132 that extends out at an angle from the support member 130 for supporting the platform 102. In the embodiment of FIG. 2, the support structure 104 includes one support member 130 and two extending members 132 that run perpendicular or substantially perpendicular to the support member.

The support member and extending members may be formed from any suitable material, but preferably formed of metal, and more preferably formed of steel or stainless steel. The use of steel or stainless steel for the support member and extending members is more advantageous than plastic because of the rising cost of plastic and the incremental cost of adding an antimicrobial agent to the plastic. Thus, according to one embodiment of the present invention, steel or stainless steel is used in the support structure (as well as the mounting brackets of the mounting structure 106) so that the design does not depend on the plastic components for holding the bed in the horizontal (useable) orientation nor providing a sturdy feel to the bed while in use. Instead, the structural steel frame design of the support and mounting structures place almost the entire load directly onto the steel components. The plastic components (such as the platform and backboard) are only used to cover the steel components and provide an aesthetically appealing product while providing minimal structure. The frame of the support structure 104 extends the length of the platform 102, or bed, so that when the baby changing station 100 is being used most of the load applied to the bed or platform is transferred to the frame members, that is the support and extending members.

Figure 5A:
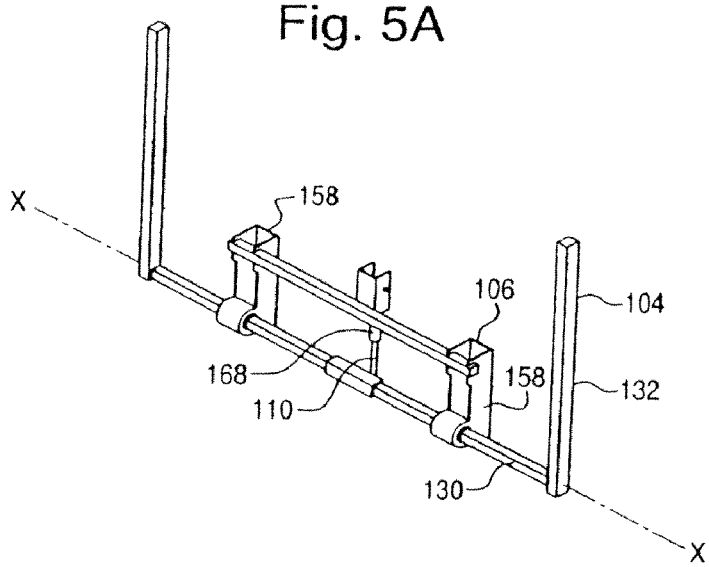
FIGS. 5A though 5C are frontal perspective views showing the configuration of the support structure, the mounting structure, and the damper system of FIG. 2 as the changing station is moved from a storage position to a use position.
Figure 5B:
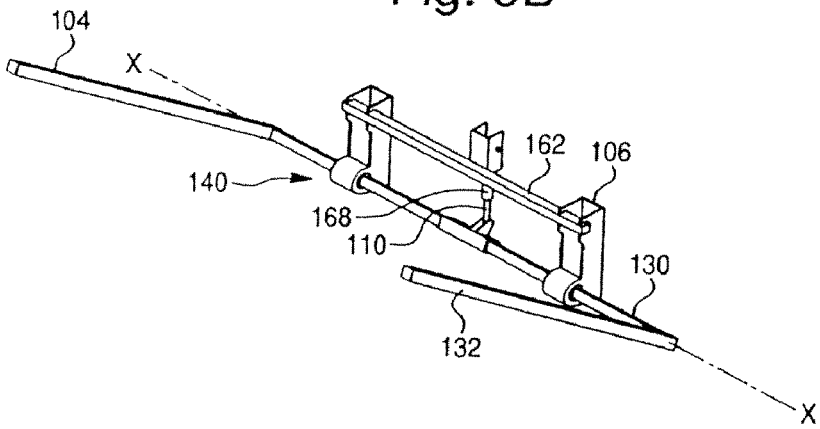
Figure 5C:
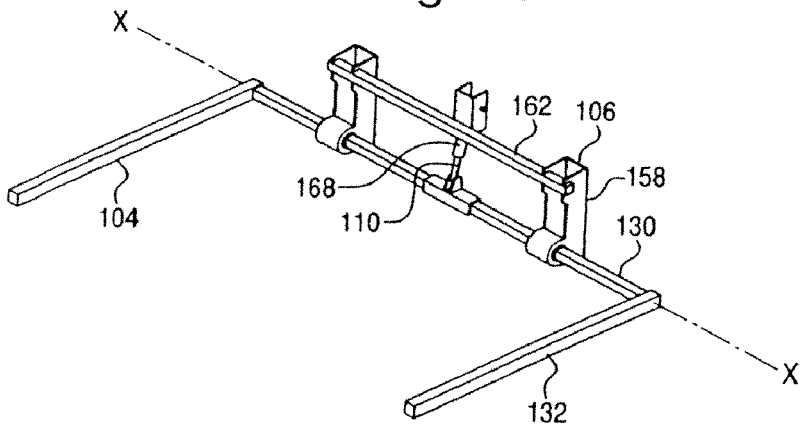
Figure 6:
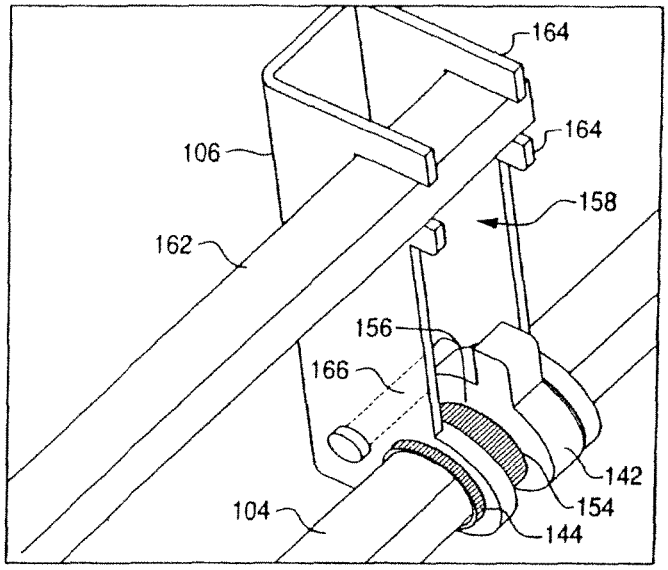
FIG. 6 is a rear detailed view of one of the rotatable joints of the support structure of FIG. 2.
Figure 7:
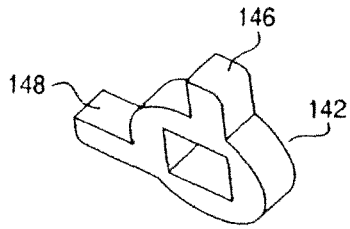
FIG. 7 is a detailed view of the steel stop of the support structure of FIG. 2.
Figure 8:
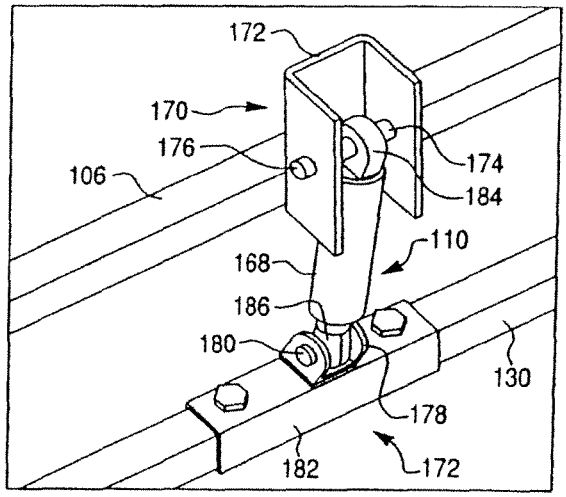
FIG. 8 is a rear perspective view of the damper system of FIG. 2 connected between the mounting and support structures.

FIGS. 5A though 5C and FIGS. 6 through 8 provide more detailed views of the support structure 104, the mounting structure 106, and the damper system 110 without the platform 102 or the backboard. FIGS. 5A through 5C show the configuration of the support structure 104 relative to the mounting structure 106 as the baby changing station is moved from a storage position to a use position. FIG. 6 shows a detailed view of one of the rotatable joints of the support structure. FIG. 7 shows a detailed view of the steel stop of the support structure. FIG. 8 shows the damper system 110 connected between the mounting and support structures.

As previously explained, the support structure 104 comprises a rotatable support member 130 and at least one (preferably two) extending members 132. The support and extending members may be any suitable cross-section and/or length. For example, the support and extending members may have a cross-section that is square, circular, U-shaped, tubular, or other suitable shapes. The extending members may be attached to the support member at its ends by any suitable mechanism, such as bolts, welding, or the like.

The support member is attached to the mounting structure 106 at the rotatable joints 140. Each rotatable joint may comprise a hinge stop 142 and a bearing 144. The hinge stop 142 may include an upper stop 146 and a lower stop 148. The hinge stop 142 is keyed so as to align with the support member 130. For example, in FIGS. 6 and 7, the hinge stop 142 has a square cut-out 150 so as to align with the square cross-section of the support member 130. The hinge stop 142 is positioned on the support member 130 using a hinge stop brace 152. The hinge stop brace 152 comprises a nylon spacer 154 that fits between the square cut-out 150 of the hinge stop 142 and the outer periphery of the support member 130 and a screw 156 for holding the nylon spacer 154 in place. The hinge stop 142 is installed into the bearing 144. The bearing 144, in turn, is press fit into the mounting bracket 158 of the mounting structure 106. The hinge stop may be made of any suitable material, such as metal or plastic. Preferably, the hinge stop is formed from metal, such as steel or stainless steel. The hinge stop is used for controlling rotation of the rotatable support member, as will be described below.

The mounting structure 106 may mount the support structure 104 to a vertical wall. The mounting structure 106 may comprise mounting brackets 158 (seen in FIG. 5A) covered by a backboard 160 (seen FIGS. 1 and 2) in the vertical direction Y, a central bracket 162, and an open/close stop 166. The mounting brackets may include one or more mounting holes to accommodate screws or other fasteners that will fix the mounting brackets 158 to the vertical wall. The mounting bracket 158 may also include a mechanism for holding the central bracket 162. In the case of FIG. 6, the mounting bracket is substantially a U-shape with two teeth-like protrusions for holding the central bracket 162 therebetween. Of course, the central bracket 162 may be attached to the mounting brackets in other fashions, such as screws or the like. In addition, the mounting bracket 158 includes two holes along its opposing sides of the U-shape in which the open/close stop 166 is inserted. The open/close stop 166 may be, for example, a clevis pin and E-clip. The mounting brackets 158 and the central bracket 162 may be made of any suitable material, such as steel, stainless steel, and/or aluminum. Furthermore, although two mounting brackets 158 and rotatable joints 140 are shown in FIGS. 5A through 5C, other number of mounting brackets 150 and rotatable joints 140 may be used, such as one, two, three, four or more. These brackets 150 and joints 140 may be in a spaced relationship.

Mounted substantially toward the center of the central bracket 162 is the damper system 110, which is configured to slow the rotation of the platform 102 when the platform moves from the vertical position to the horizontal position. As seen in FIG. 8, the damper system may comprise at least one gas spring 168, an upper spring connector 170, and a lower spring connector 171.

The upper spring connector 170, for example, includes an attachment bracket 172 which may be attached by bolts, welding, or the like to the central bracket 162. The attachment bracket 172 is generally U-shaped with holes 176 on the two opposing side portions in which a retaining pin 174 is insert therethrough and fixed into place. The attachment portion 184 of the gas spring 168 is rotatably attached to the retaining pin and/or the attachment portion 184 and retaining pin 174 are rotatably attached to the attachment bracket 172.

The lower spring connector 171, for example, includes an attachment bracket 178 which may be attached by bolts, welding, or the like to the secondary attachment bracket 182. The secondary attachment bracket 182, in turn, is attached to the support member 130 via an attachment mechanism, such as bolts. The attachment bracket 178 and the secondary attachment bracket 182 may be generally U-shaped. The attachment bracket 178 may include holes on the two opposing side portions in which a retaining pin 180 is insert therethrough and fixed into place. The attachment portion 186 of the gas spring is rotatably attached to the retaining pin 180 and/or the attachment portion 186 and retaining pin 180 (as a unit) are rotatably attached to the attachment bracket 178. The lower and upper spring connectors may be made from any suitable material, such as steel, stainless steel, or any other suitable metal.

It is noted that if steel or stainless steel is used to form the support member, the extending members, the attachment brackets, the central bracket, and the mounting brackets, the skeletal frame of the baby changing station formed from these elements provide strength so as to support the platform (which may be formed from plastic or other light weight material).

Figure 9A:
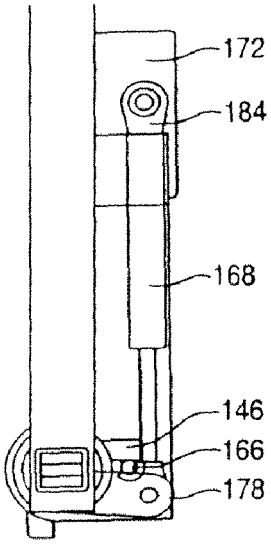
FIGS. 9A through 9C are side views showing the operation of the rotatable joints and the damper system of FIG. 5A while the platform is rotated from its storage position to its use position.
Figure 9B:
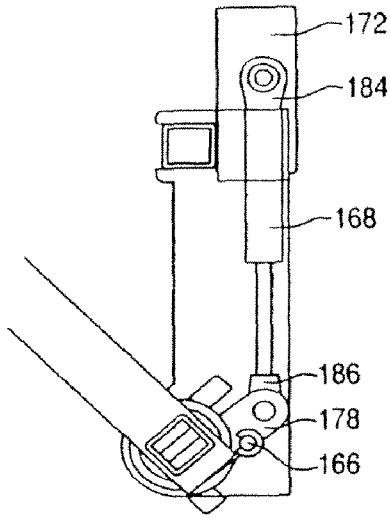
Figure 9C:
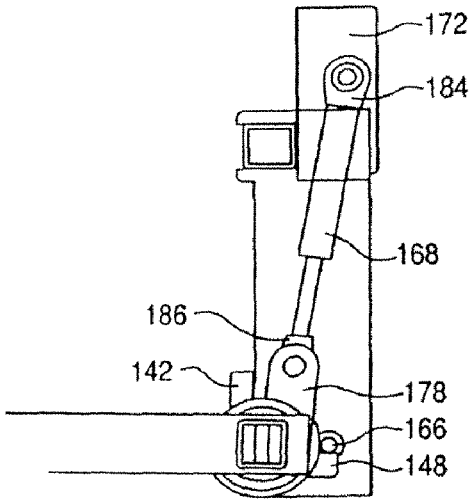

The gas spring 168 may be configured to compress as the platform is moved from the vertical position to the horizontal position and extends when the platform is moved from the horizontal position to the vertical position, as will be explained in reference to FIGS. 5A through 5C and FIGS. 9A and 9C. FIGS. 9A through 9C shows the operation of the rotatable joints and the damper system while the platform is lowered from its storage position to its use position. A preferred gas spring 168 is a Suspa 220N Two-way Damping gas spring, part number C16-26943 for a horizontal baby changing station and a Suspa 325N Two-Way Damping gas spring, part number C16-26945 for a vertical baby changing station.

As will be seen, the support structure 104, the mounting structure 106, and the damper system 110 can be configured to reduce or eliminate any forces applied to the plastic components (such as a plastic platform) that would cause stress or deformation of those components. This is a closed system of steel components that can technically operate without any plastic components in place.

In FIGS. 5A and 9A, the platform would be in the vertical storage position (the closed position). As the platform is pulled down to the horizontal use position (the open position), the attachment brackets 172 and 178 move closer to each other during the rotation of the support member 130, which causes the gas spring 168 to compress as it rotates relative to the attachment brackets 172 and 178. Eventually the cantilevered weight force of the platform overcomes the gas spring force and the platform begins to slowly fall to the open position. At the open position, the lower stop 148 of the hinge stop 142 contacts the open/close stop 166 and the platform stops falling. In FIGS. 5C and 9C, the platform is now in the open position with the gas spring 168 almost fully compressed, the lower stop 148 of the hinge stop 142 in contact with the open/close stop 166, and the attachment brackets 172 and 178 at their closest distance relative to each other. In the use or open position, the support structure 104 (or bed frame) rotates and stops by using the cast steel hinge stops 142 such that the plastic components (such as the plastic platform) undergo minimal loading.

As the platform is pulled up to the closed position, the attachment brackets 172 and 178 move farther away from each other as the support member 130 rotates, which causes the gas spring 168 to extend as it rotates relative to the attachment brackets 172 and 178. Eventually the force of the gas spring 168 overcomes the cantilevered weight force and the platform begins to slowly rise to the closed position. At the closed position in FIGS. 5A and 9A, the upper stop 146 of the hinge stop 142 contacts the open/close stop 166 and the platform stops moving. In the closed position, the gas spring 168 is almost fully extended and the upper stop 146 of the hinge stop 142 is in contact with the open/close stop 166.

With the above-described damper system 110, the opening and closing speed of the platform is slowed down for ease of use and lessens impact providing for longevity of the baby changing station. Furthermore, the steel hinge stops 142 may control the rotation of the platform and stop the platform in the useable orientation and the closed position.

Figure 11A:
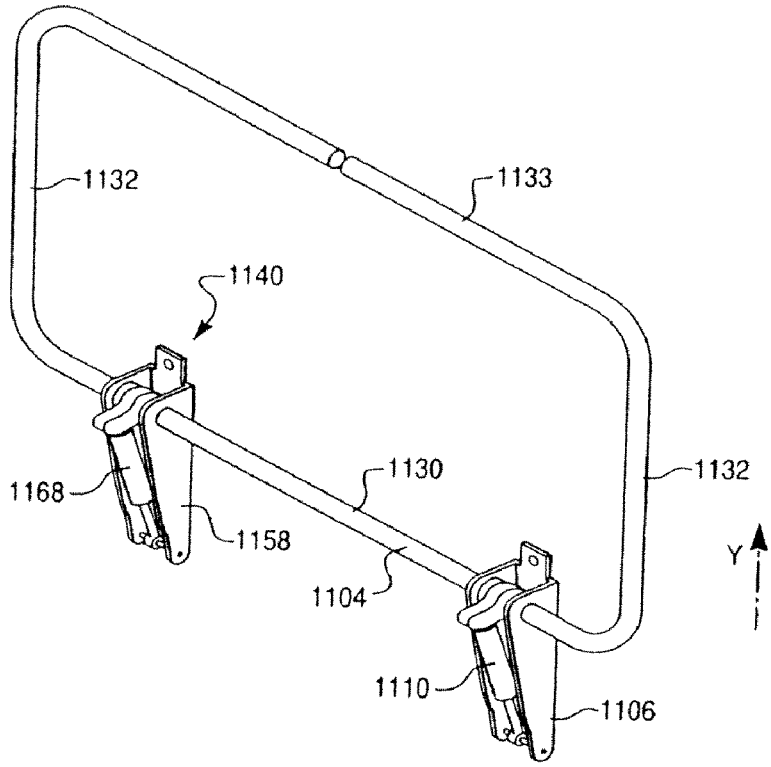
FIGS. 11A through 11C are perspective views of an alternative configuration of the support structure, the mounting structure, and the damper system as the changing station is moved from a storage position to a use position
Figure 11B:
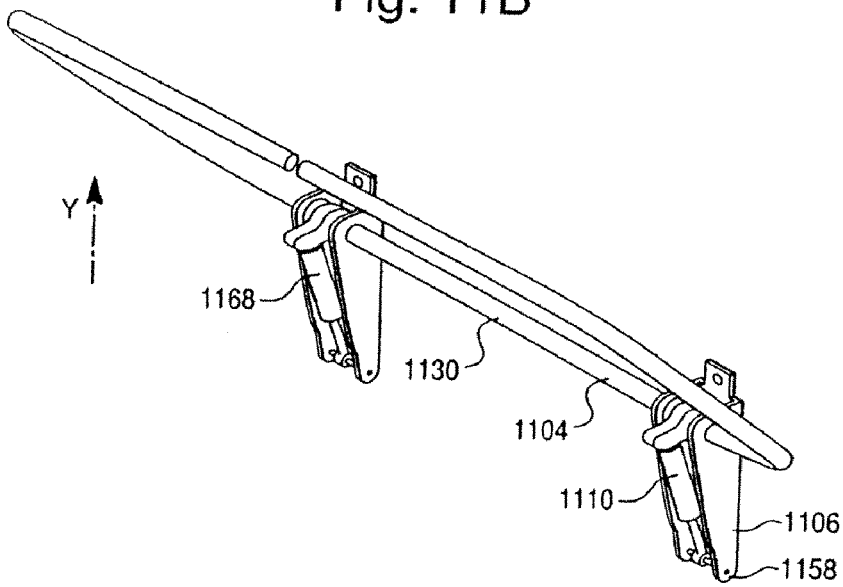
Figure 11C:
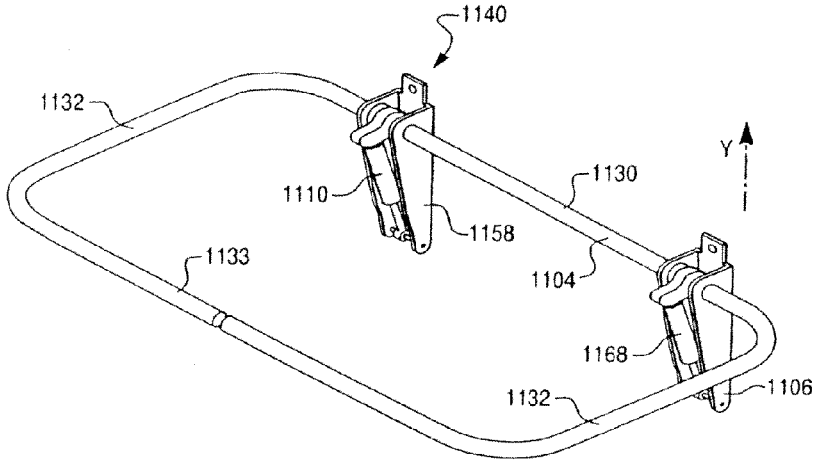
Figure 12A:
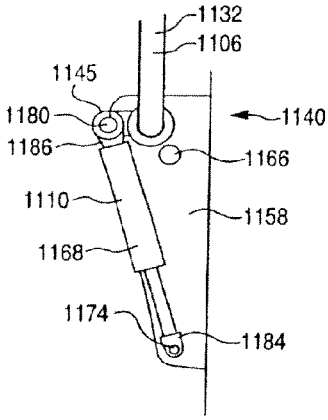
FIGS. 12A through 12C are side views showing the operation of the rotatable joints and the damper system of FIG. 11A while the platform is rotated from its storage position to its use position.
Figure 12B:
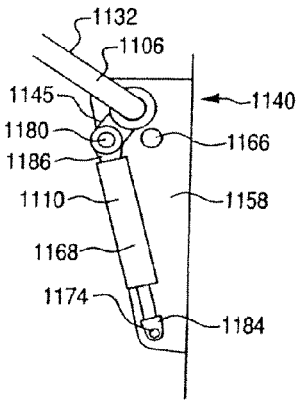
Figure 12C:
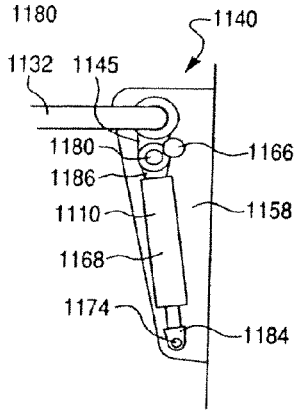
Figure 13:
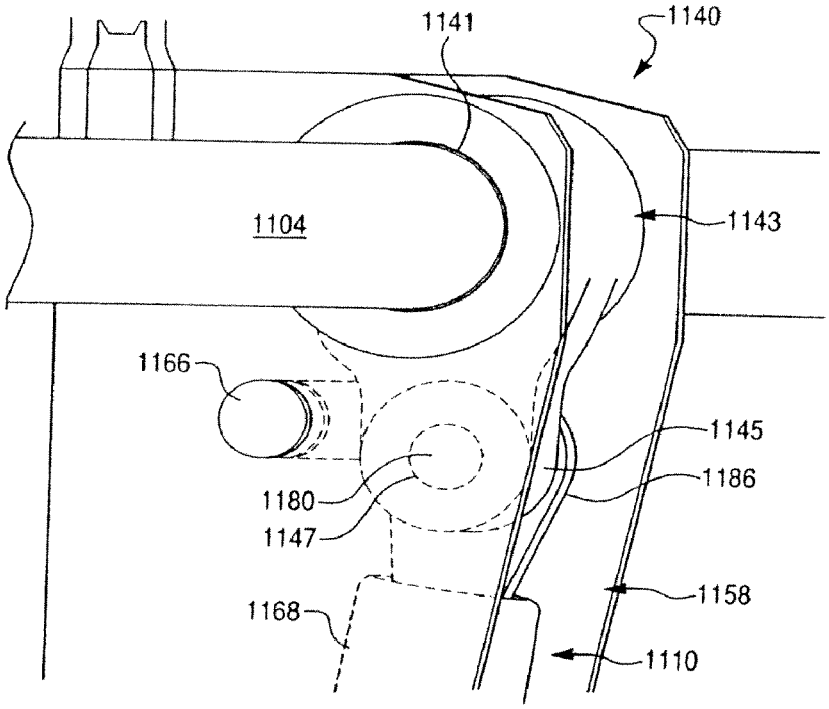
FIG. 13 is a detailed view of one of the rotatable joints of the support structure of FIG. 11A.

Besides the above described support structure, mounting structure, and damper system, other configurations of these systems are also contemplated. For example, FIGS. 11A though 11C, 12A through 12C, and 13 provide another configuration of the support structure, mounting structure, and damper system according to another embodiment of the present invention. FIGS. 11A through 11C show the configuration of the support structure 1104 relative to the mounting structure 1106 as the baby changing station is moved from a storage position to a use position. FIGS. 12A through 12C show detailed views of one of the rotatable joints of the support structure as the baby changing station is moved from a storage position to use position. FIG. 13 shows a detailed view of the rotatable joint of the mounting structure of FIG. 11A.

The support structure 1104 comprises a rotatable support member 1130 and at least one (preferably two) extending members 1132. Optionally, the two extending members may be connected to each other by a bridging section 1133. Although FIG. 11A shows the support and extending members being round, the support and extending members may be any suitable cross-section and/or length. For example, the support and extending members may have a cross-section that is square, circular, U-shaped, tubular, or other suitable shape. FIG. 11A shows that the support and extending members may be tubular, in which the end of one member fits inside the end of an adjoining member. However, the extending members may be attached to the support member at its ends by any suitable mechanism, such as bolts, welding, or the like.

The support member is attached to the mounting structure 1106 at the rotatable joints 1140. As seen in FIG. 13, each rotatable joint may comprise a spring mount 1143. The spring mount 1143 is positioned on the support member 1130, and rotates integrally with the support member 1130 via press-fit, a keyed structure, a fastening with screws or any other known fastening mechanism. The spring mount 1143 includes a hole 1141 through which the support member 1130 is fed through and a protrusion 1145 with a hole 1147 through which a retaining pin 1180 is fed through. The spring mount may be made of any suitable material, such as metal or plastic, but it is, preferably, formed from metal, such as steel or stainless steel.

The mounting structure 1106 may mount the support structure 1104 to a vertical wall. The mounting structure 1106 may comprise one or more mounting brackets 1158 covered by a backboard (not shown) running along the vertical direction Y and a bed open stop 1166. The mounting brackets 1106 may include one or more mounting holes to accommodate screws or other fasteners that will fix the mounting brackets 1158 to the vertical wall. In the case of FIGS. 11A through 11C, the mounting bracket is substantially a U-shape with pairs of holes in the opposing side walls of the U-shape so as to accommodate the bed open stop 1166, the rotating pin 1174, and the support member 1130 passing across the gap between the opposing side walls. The bed open stop 1166 may be, for example, a clevis pin and E-clip. The mounting brackets 1158 may be made of any suitable material, such as steel, stainless steel, and/or aluminum. Furthermore, although two mounting brackets 1158 and rotatable joints 1140 are shown in FIGS. 11A through 11C, other number of mounting brackets 1158 and rotatable joints 1140 may be used, such as one, two, three, four or more. These brackets 1158 and rotatable joints 1140 may be in a spaced relationship.

Mounted within the two opposing side walls of the mounting bracket 1158 is the spring tube mount 1143 and the damper system 1110, which is configured to slow the rotation of the platform when the platform moves from the vertical position to the horizontal position. The damper system 1110 may comprise at least one gas spring 1168 with attachment portions 1184 and 1186. The attachment portion 1184 of the gas spring 1168 is rotatably attached to the retaining pin 1174 and/or the attachment portion 1184 and retaining pin 1174 (as a fixed unit) are rotatably attached to the mounting bracket 1158. The attachment portion 1186 of the gas spring is rotatably attached to a retaining pin 1180 and/or the attachment portion 1186 and retaining pin 1180 (as a fixed unit) are rotatably attached to the spring mount 1143 through the hole 1180 on the protrusion 1145. The attachment portion 1186 is attached to the spring mount 1143 by any suitable fastening mechanism. It is noted that if steel is used to form the support member, the extending members and the mounting brackets, the skeletal frame of the baby changing station formed from these elements provide strength so as to support the platform (which may be formed from plastic or other light weight material).

The gas spring 1168 may be configured to compress as the platform is moved from the vertical position to the horizontal position and extends when the platform is moved from the horizontal position to the vertical position, as will be explained in reference to FIGS. 11A through 11C and FIGS. 12A through 12C. FIGS. 11A through 11C show the operation of the rotatable joints and the damper system while the platform is lowered from its storage position to its use position.

The purpose of the support structure 1104, the mounting structure 1106, and the damper system 1110 is to eliminate any forces applied to the plastic components (such as a plastic platform) which would cause stress or deformation of those components.

In FIGS. 11A and 12A, the platform is in the vertical storage position (the closed position). As the platform is pulled down to the horizontal use position (the open position), the protrusion 1145 of the spring mount 1143 moves closer to the fixed location of retaining pin 1174 during the rotation of the support member 1130, which causes the gas spring 1168 to compress as it rotates relative to the mounting brackets 1158. Eventually the cantilevered weight force of the platform overcomes the gas spring force and the platform begins to slowly fall to the open position. At the open position, the protrusion 1145 contacts the bed open stop 1166 and the platform stops falling. In FIGS. 11C and 12C, the platform is now in the open position with the gas spring 1168 almost fully compressed, the protrusion 1145 of the spring mount 1143 in contact with the bed open stop 1166, and positions of the retaining pins 1180 and 1174 are at their closest distance relative to each other. In the use or open position, the support structure 1104 (or bed frame) rotates and stops by using the cast steel open bed stop 1166 such that the plastic components (such as the plastic platform) undergo minimal loading.

As the platform is pulled up to the closed position, the locations of the retaining pins 1180 and 1174 move farther away from each other as the support member 1130 rotates, which causes the gas spring 1168 to extend as it rotates relative to the mounting bracket 1158. Eventually the force of the gas spring 1168 overcomes the cantilevered weight force and the platform begins to slowly rise to the closed position. At the closed position in FIGS. 11A and 12A, the gas spring 1168 is fully extended; thus preventing the platform from rotating any farther.

Figure 14:
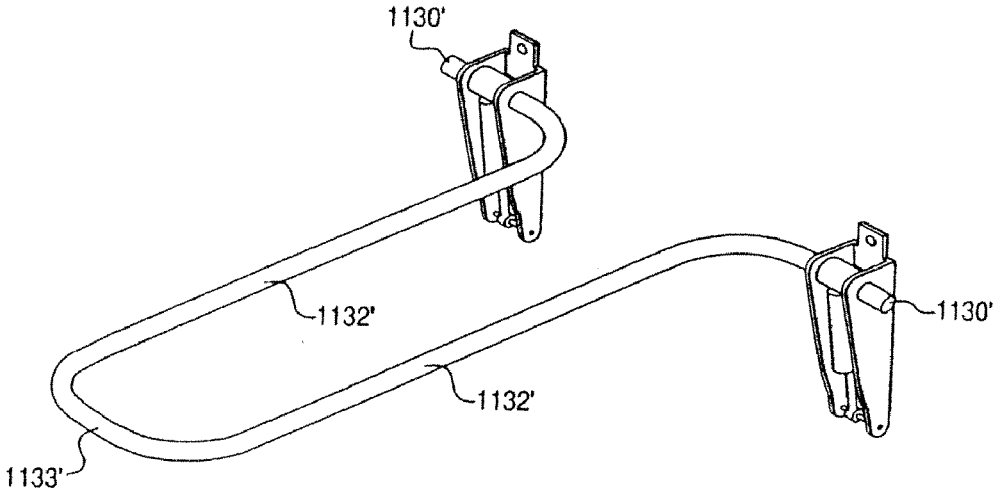
FIG. 14 is a front perspective view of an alternative configuration of the support structure, the mounting structure, and the damper system according to an embodiment of the present invention.

FIG. 14 shows an alternative embodiment of the support structure from the support structure 1130 of FIGS. 11A through 11C. Instead of the support member and the extending members being part of an enclosed loop, a plurality of support members 1130' is used in which the extending members 1132' extend out from an end of the support members 1130' and then connect at a bridging section 1133'. All other elements of FIG. 14 are substantially the same as the embodiment of FIGS. 11A through 11C.

Figure 15A:
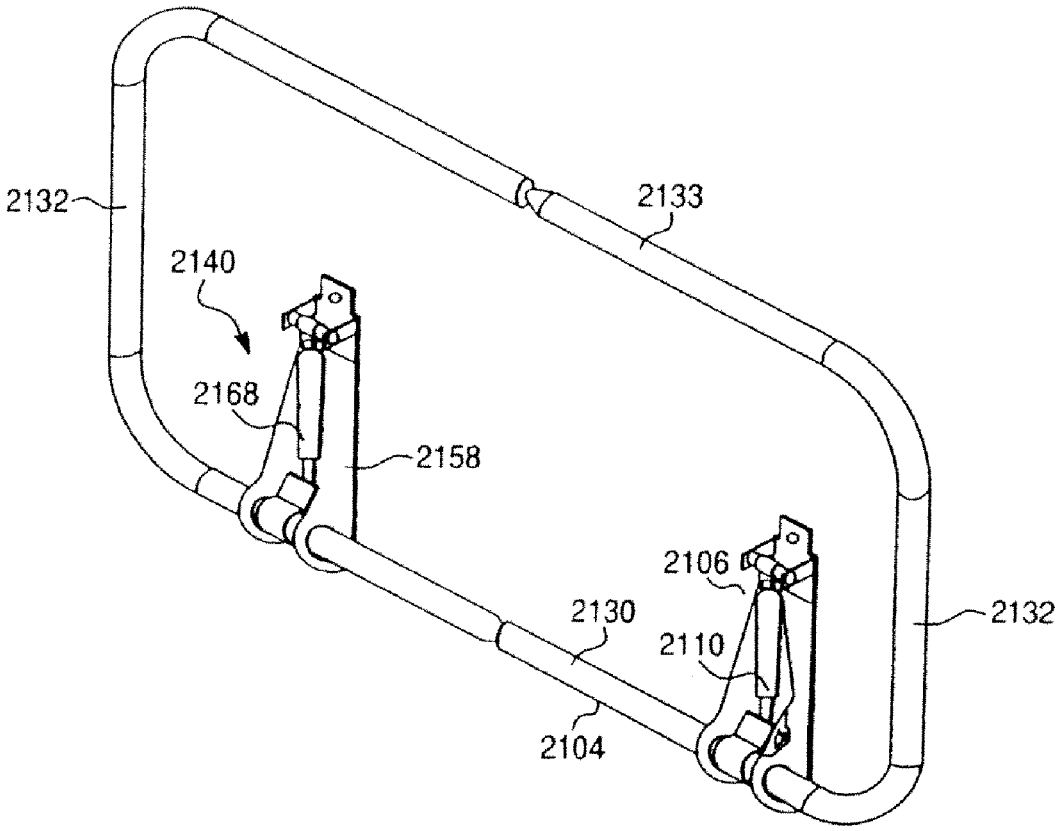
FIGS. 15A through 15C are perspective views of an alternative configuration of the support structure, the mounting structure, and the damper system as the changing station is moved from a storage position to a use position
Figure 15B:
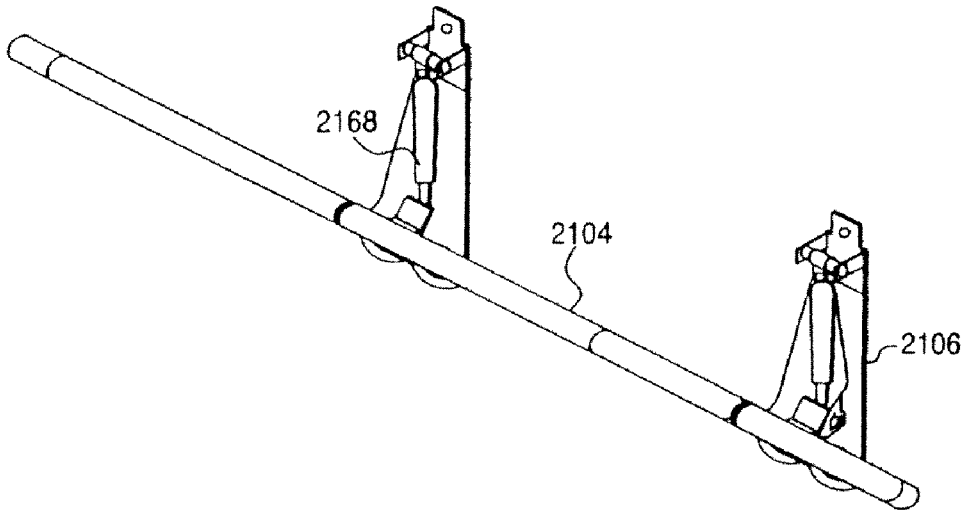
Figure 15C:
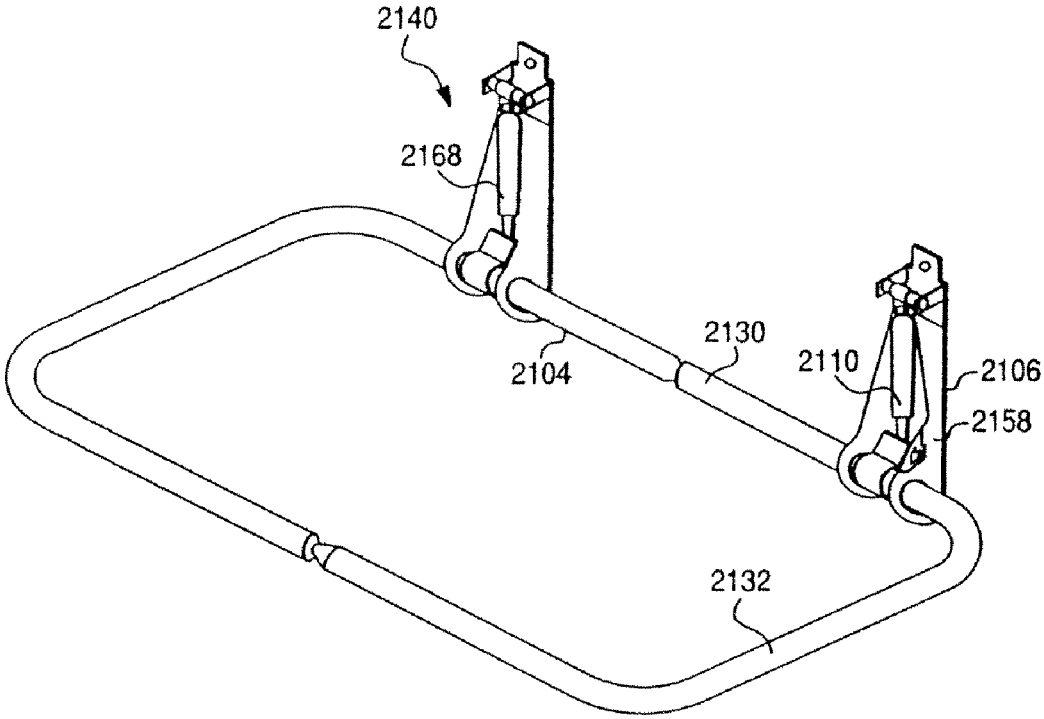
Figure 16A:
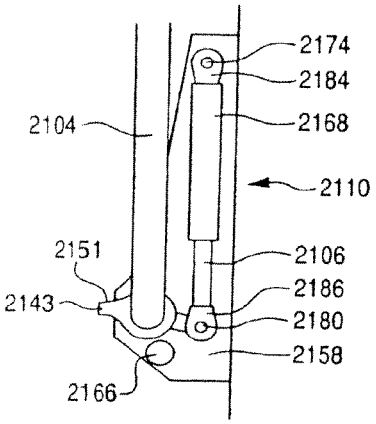
FIGS. 16A through 16C are side views showing the operation of the rotatable joints and the damper system of FIG. 15A while the platform is rotated from its storage position to its use position.
Figure 16B:
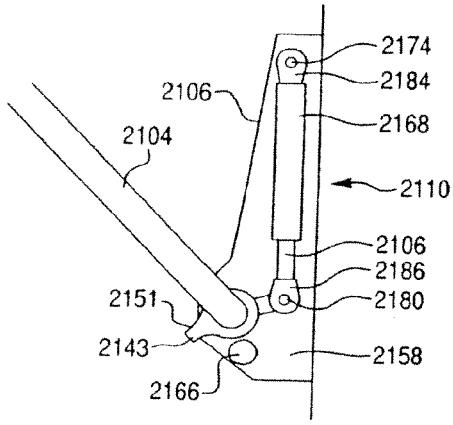
Figure 16C:
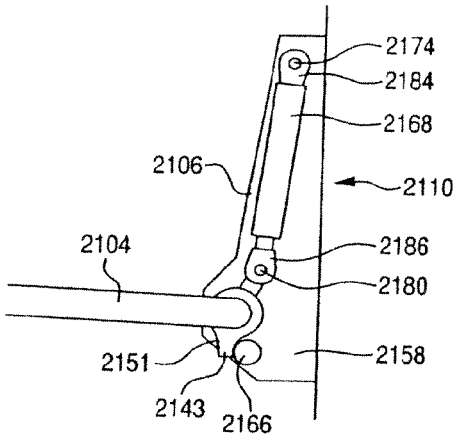
Figure 17:
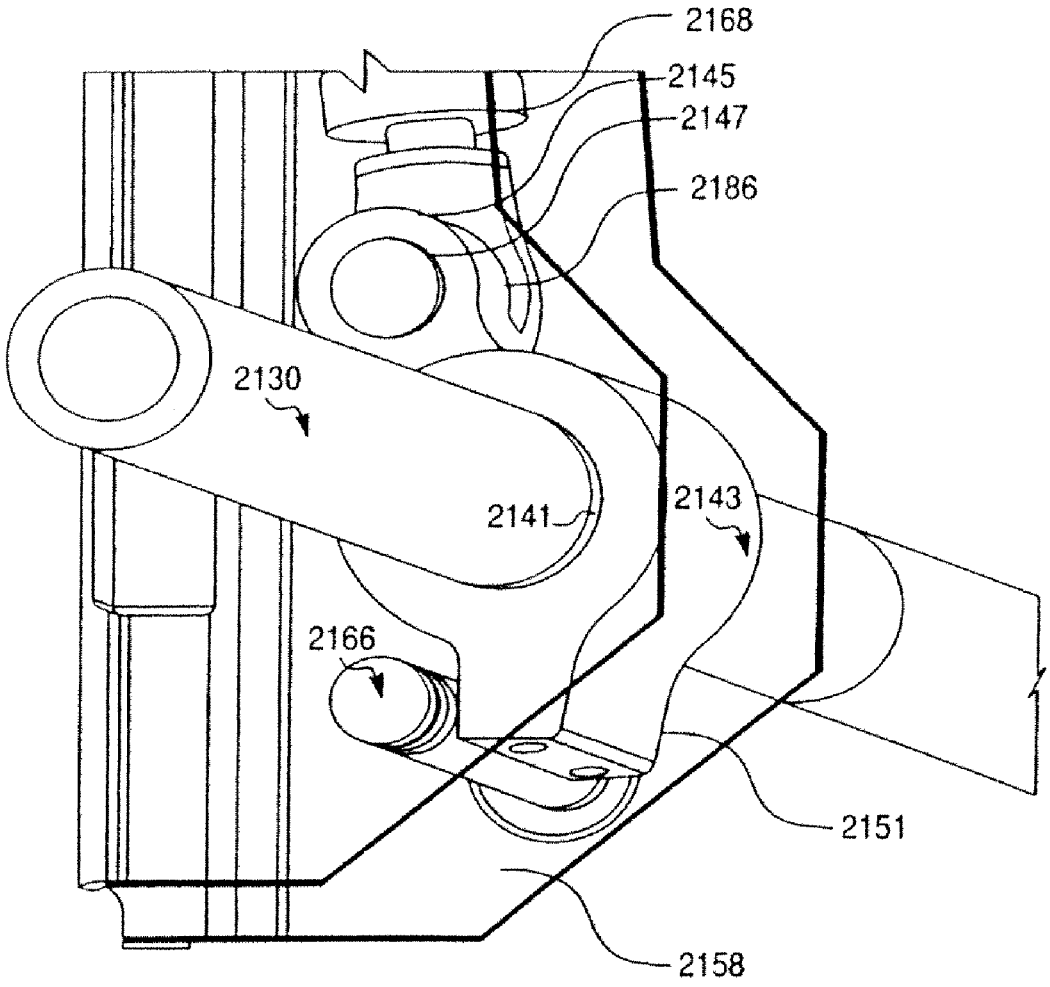
FIG. 17 is a detailed view of one of the rotatable joints of the support structure of FIG. 15A.

FIGS. 15A though 15C, 16A through 16C, and 17 provide another configuration of the support structure, mounting structure, and damper system according to another embodiment of the present invention. FIGS. 15A through 15C show the configuration of the support structure 2104 relative to the mounting structure 2106 as the baby changing station is moved from a storage position to a use position. FIGS. 16A through 16C show detailed views of one of the rotatable joints of the support structure as the baby changing station is moved from a storage position to use position. FIG. 17 shows a detailed view of the rotatable joint of the mounting structure of FIG. 15A.

The support structure 2104 comprises a rotatable support member 2130 and at least one (preferably two) extending members 2132. Optionally, the extending members may be connected to each other via a bridging section 2133. Although FIG. 15A shows the support and extending members being round, the support and extending members may be any suitable cross-section and/or length. For example, the support and extending members may have a cross-section that is square, circular, U-shaped, tubular, or other suitable shape. FIG. 15A shows that the support and extending members may be tubular, in which the end of one member fits inside the end of an adjoining member. However, the extending members may be attached to the support member at its ends by any suitable mechanism, such as bolts, welding, or the like.

The support member is attached to the mounting structure 2106 at the rotatable joints 2140. As seen in FIG. 17, each rotatable joint may comprise a spring mount 2143. The spring mount 2143 is positioned on the support member 2130, and rotates integrally with the support member 2130 via press-fit, a keyed structure, a fastening with screws or any other known fastening mechanism. The spring mount 2143 includes a hole 2141 through which the support member 2130 is fed through; a first protrusion 2145 with a hole 2147 through which a retaining pin 2180 is fed through; and a second protrusion 2151. The spring mount may be made of any suitable material, such as metal or plastic, but it is, preferably, formed from metal, such as steel or stainless steel.

The mounting structure 2106 may mount the support structure 2104 to a vertical wall. The mounting structure 2106 may comprise one or more mounting brackets 2158 covered by a backboard (not shown) running along the vertical direction Y and a bed open stop 2166. The mounting brackets 2106 may include one or more mounting holes to accommodate screws or other fasteners that will fix the mounting brackets 2158 to the vertical wall. In the case of FIGS. 15A through 15C and FIGS. 16A through 16C, the mounting bracket is substantially a U-shape with pairs of holes in the opposing side walls of the U-shape so as to accommodate the bed open stop 2166, the rotating pin 2174, and the support member 2130 passing across the gap between the opposing side walls. The bed open stop 2166 may be, for example, a clevis pin and E-clip. The mounting brackets 2158 may be made of any suitable material, such as steel, stainless steel, and/or aluminum. Furthermore, although two mounting brackets 2158 and rotatable joints 2140 are shown in FIGS. 51A through 51C, other number of mounting brackets 2158 and rotatable joints 2140 may be used, such as one, two, three, four or more. These brackets 2158 and rotatable joints 2140 may be in a spaced relationship.

Mounted within the two opposing side walls of the mounting bracket 2158 is the spring tube mount 2143 and the damper system 2110, which is configured to slow the rotation of the platform when the platform moves from the vertical position to the horizontal position. The damper system 2110 may comprise at least one gas spring 2168 with attachment portions 2184 and 2186. The attachment portion 2184 of the gas spring 2168 is rotatably attached to the retaining pin 2174 and/or the attachment portion 2184 and retaining pin 2174 (as a fixed unit) are rotatably attached to the mounting bracket 2158. The attachment portion 2186 of the gas spring is rotatably attached to a retaining pin 2180 and/or the attachment portion 2186 and retaining pin 2180 (as a fixed unit) are rotatably attached to the spring mount 2143 through the hole 2147 on the protrusion 2145. The attachment portion 2186 is attached to the spring mount 2143 by any suitable fastening mechanism. It is noted that if steel is used to form the support member, the extending members and the mounting brackets, the skeletal frame of the baby changing station formed from these elements provide strength so as to support the platform (which may be formed from plastic or other light weight material).

The gas spring 2168 may be configured to compress as the platform is moved from the vertical position to the horizontal position and extends when the platform is moved from the horizontal position to the vertical position, as will be explained in reference to FIGS. 15A through 15C and FIGS. 16A through 16C. FIGS. 15A through 15C shows the operation of the rotatable joints and the damper system while the platform is lowered from its storage position to its use position.

As will be seen, the purpose of the support structure 2104, the mounting structure 2106, and the damper system 2110 is to eliminate any forces applied to the plastic components (such as a plastic platform) which would cause stress or deformation of those components.

In FIGS. 15A and 16A, the platform is in the vertical storage position (the closed position). As the platform is pulled down to the horizontal use position (the open position), the protrusion 2145 of the spring mount 2143 moves closer to the fixed location of retaining pin 2174 during the rotation of the support member 2130, which causes the gas spring 2168 to compress as it rotates relative to the mounting brackets 2158. Eventually the cantilevered weight force of the platform overcomes the gas spring force and the platform begins to slowly fall to the open position. At the open position, the second protrusion 2151 contacts the bed open stop 2166 and the platform stops falling. In FIGS. 15C and 16C, the platform is now in the open position with the gas spring 2168 almost fully compressed, the protrusion 2151 of the spring mount 2143 in contact with the bed open stop 2166, and positions of the retaining pins 2180 and 2174 are at their closest distance relative to each other. In the use or open position, the support structure 2104 (or bed frame) rotates and stops by using the cast steel open bed stop 2166 such that the plastic components (such as the plastic platform) undergo minimal loading.

As the platform is pulled up to the closed position, the locations of the retaining pins 2180 and 2174 move farther away from each other as the support member 2130 rotates, which causes the gas spring 2168 to extend as it rotates relative to the mounting bracket 2158. Eventually the force of the gas spring 2168 overcomes the cantilevered weight force and the platform begins to slowly rise to the closed position. At the closed position in FIGS. 15A and 16A, the gas spring 2168 is fully extended; thus preventing the platform from rotating any farther.

Figure 18:
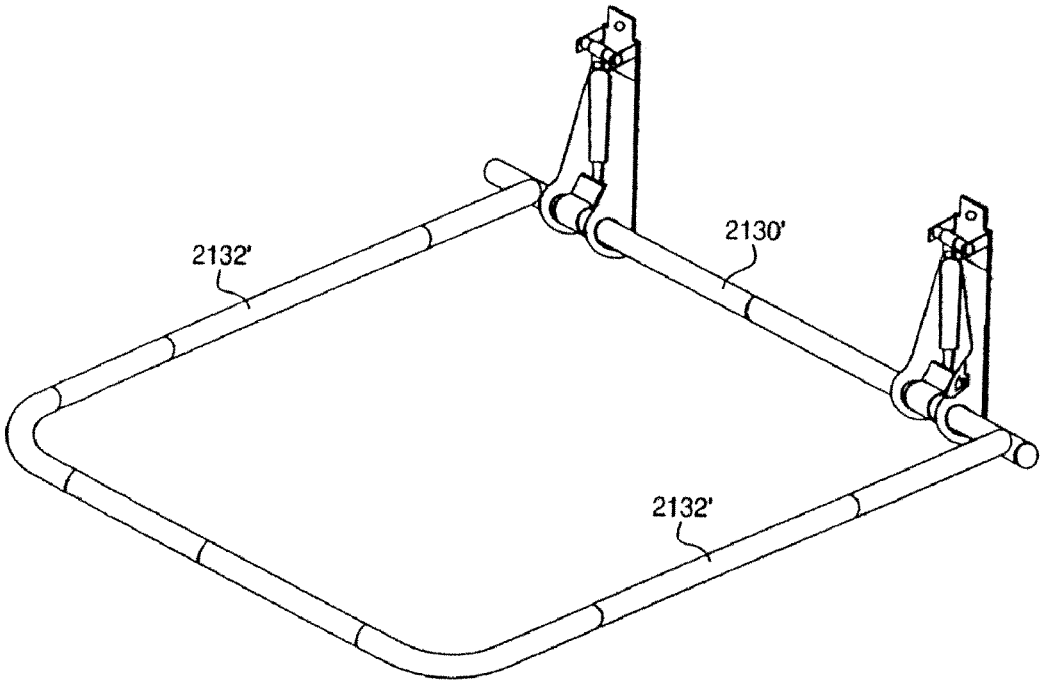
FIG. 18 is a front perspective view of an alternative configuration of the support structure, the mounting structure, and the damper system according to an embodiment of the present invention.

FIG. 18 shows an alternative embodiment of the support structure from the support structure 2130 of FIGS. 15A through 15C. Instead of the support member and the extending members being part of a continuous enclosed loop, the extending members 2132' protrude out the circumferential surface of the support member 2130' such that the ends of the support member 2130' extend beyond the positions of the extending members 2132' in the length direction of the support member 2130'. The extending members 2132' can be attached to the support member 2130' by welding, for example. All other elements of FIG. 18 are substantially the same as the embodiment of FIGS. 15A through 15C.

Referring back to FIGS. 1 and 2, the mounting structure 106 also comprises a backboard 160 that covers the mounting brackets 158 (seen in FIG. 5A). The backboard may be formed of any suitable material, such as polypropylene plastic made using high-pressure injection molding technology or other suitable plastic (with or without anti-microbial additives). The backboard may comprise a base portion 188, a hinge portion 190, and a shelf member 192. The base portion, hinge portion and shelf member may all be one integral piece of a plurality of pieces attached to each other by any suitable mechanism, such as bolts, adhesives, welding, or the like.

The base portion may have a smooth front surface 196, which is aesthetically pleasing to the public, and a back surface 198 that is formed to accommodate the damper system 110 and the rest of the mounting structure 106, 1106, 2106 (such as the mounting brackets 158, 1158, 2158; the central bracket 162; the gas spring 168, 1168, 2168; etc). The back surface 198 may include a plurality of ribs 200 that run horizontally or vertically such that the components of the mounting structure 106 and the damper system 110 can be accommodated within the base portion 188 while providing suitable reinforcement to inhibit or prevent buckling or deformation of the base portion.

The hinge portion 190 of the backboard is attached to the base portion 188 and covers the support member 130 and the rotatable joints 140. A cut-out 202 in the platform 102 accommodates the hinge portion 190 of the backboard such that the platform may rotate upwards, as seen in FIGS. 3A and 3B. The cut-out 202 may be large enough to only permit the hinge portion 190 to smoothly enter the cut-out during the rotation of the platform.

Either protruding out from the base portion 188 or recessed into the base portion may be at least one or more shelf members 192. The at least one shelf member 192 may be spaced at a vertical distance from the platform 102 when the platform is in the horizontal position. A partition 194 may also divide the shelf member 192 into two shelf members. The number of shelf members 192 can be any suitable number, such as one, two, three, four, or more. The at least one shelf member 192 provides a location or locations for placement of a variety of small items such as baby powder, a Vaseline tube, a cell phone, lotions, and other small accessories across the back of the baby changing station. The shelf member may be any suitable size, such as 2" wide by 14" long.

Besides the embodiment shown in FIG. 1, the backboard may take any desirable shape or configuration. For example, FIGS. 4A though 4J shows different backboards that may be used with the baby changing platform. The backboard 160A of FIG. 4A is similar to the platform of FIG. 1 but has no partition dividing the shelf member 192A and has a liner dispenser 223 in the base portion 160A. The liner dispenser 223 contains paper bed liners (which can be sheets of large tissue paper). In one example, the dispenser may be able to hold a minimum of 40 liners.

The backboard 160B of FIG. 4B is similar to the platform of FIG. 1 but has no partition dividing the shelf member 192B and a cutout 224 in the base portion 160B. The backboards 160C through 160H of FIGS. 4C through 4H have a variety of different shapes, and can be made from a variety of different materials, such as stainless steel, steel, aluminum, or other metal, or polypropylene plastic made using high-pressure injection molding technology or other suitable plastic. The backboards 160C through 160H of FIGS. 4C through 4H have no shelf member.

The backboard 1601 of FIG. 41 includes a liner dispenser 226, a well 228 for accommodating a hand sanitizer pump dispenser (such as Purell 9652, Purell 9659, or Kimberly Clark 93060), a shelf member 1921, and one or more warning labels 230. The warning labels can be decals, painted on, or the like which provide pictorials, text, or a combination thereof. The liner dispenser 226 is configured for dispensing bed liner for the platform. The liner dispenser 226 contains paper bed liners (which can be sheets of large tissue paper), and can be installed in an accommodating space 232 in the backboard. When the liner dispenser 226 is empty, the shelf portion 234 can be raised, the dispenser 226 refilled, and the dispenser 226 may be lowered back into the accommodating space 232.

Figure 4J:
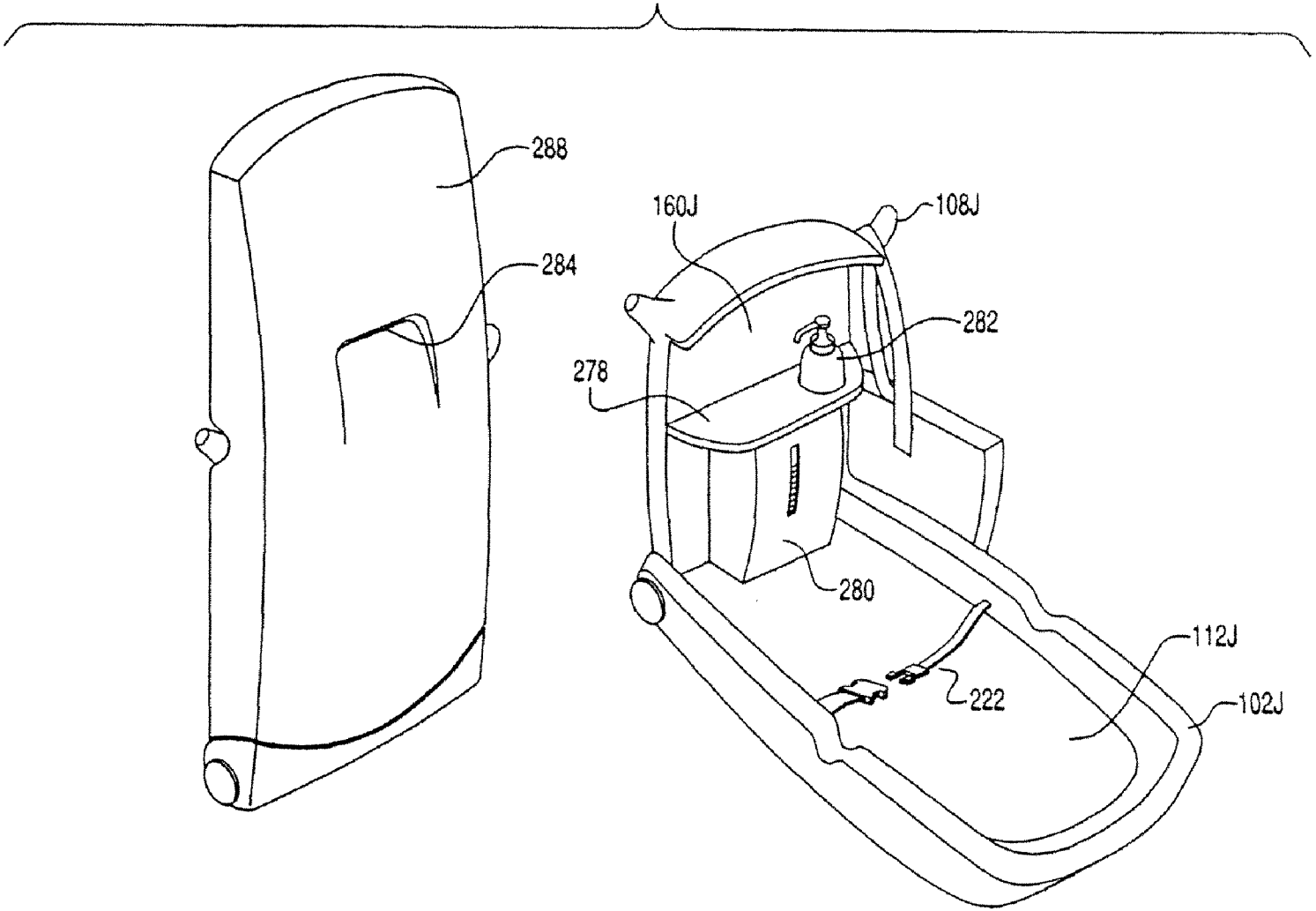

The backboard 160J of FIG. 4J includes a liner dispenser 280, which can tilt-out when it needs refilling. A shelf member 278 may protrude out from the backboard 160J at a vertical distance above the platform 102J. The shelf member may comprise a hand sanitizer holder 282, which retains a hand sanitizer pump dispenser. The hand sanitizer holder 282 may be a recess in the upper surface of the shelf member 278 or may be a rim that protrudes out from the upper surface of the shelf member 278 in which the pump dispenser is placed therein.

Figure 10A:
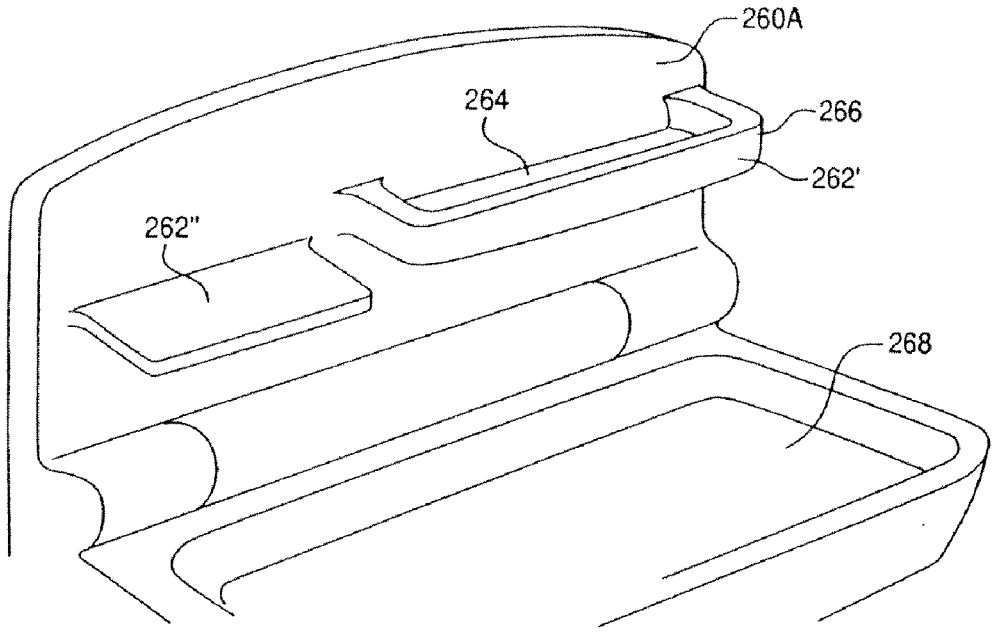
FIGS. 10A and 10B are frontal perspective views of changing stations with different configurations for the shelf members.
Figure 10B:
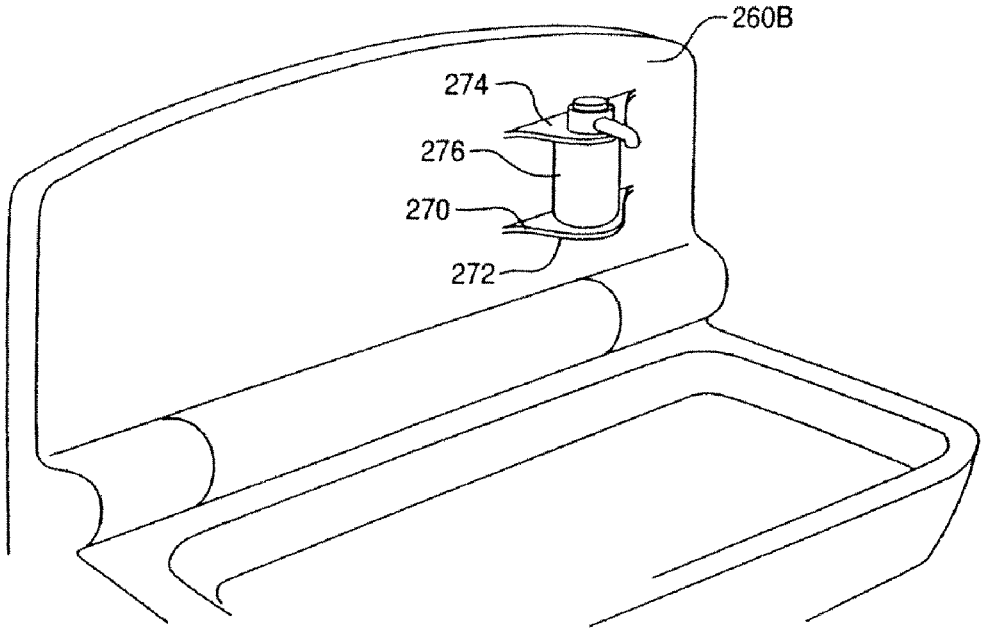

Additional embodiments of the backboard are also presented in FIGS. 10A and 10B. In FIG. 10A, the backboard 260A incorporates two shelf members 262' and 262" for the use of holding items. The shelf member 262' comprises a flat bottom surface 264 and a continuous side wall 266 for retaining miscellaneous items on the shelf member 262'. The shelf member 262" is a rectangular protrusion with no side walls for retaining wipe containers, etc. Both shelf members 262' and 262" have rounded corners and edges, and may be placed at the same height above the platform 268 or at different heights above the platform 268. In FIG. 10B, the shelf member 270 protrudes out from the backboard 260B. In this embodiment, the shelf member 270 comprises a lower portion 272 on which a hand sanitizer dispenser 276 rests and an upper portion 274 which has a hole through which the dispenser spout protrudes so as to retain the dispenser 276 on the lower portion 272.

Referring back to FIG. 1, the baby changing station may also include at least one hanging member 108 located on the backboard 160. In a preferred embodiment, there may be at least two hanging members, as seen in FIG. 1. The at least one hanging member 108 is located on the backboard 160 of the mounting structure 106 such that the hanging member 108 is spaced at a vertical distance from the platform 102 when the platform 102 is in the horizontal position. For example, the at least one hanging member 108 is located at least higher than the vertical midpoint 236 between the top of the backboard and the top surface of the platform. More preferable, the at least one hanging member is located at least three-quarters (or even seven-eighths) upward between the top of the backboard and the top surface of the platform.

The hanging member(s) can be configured to be used, for example, as hangers or hooks for diaper bag handles. Having the hanging member placed at a substantial vertical distance from the platform may be preferable over having the hooks located on the platform or bed because hooks on the platform may create a situation where the diaper bag handles and bag hang lower than the bed, almost touching the floor; thus requiring parents to bend down below the platform level to get items out of their diaper bags and taking their attention off of the baby, a dangerous practice. With the hanging member mounted high on the backboard which accepts diaper bag hand straps, the parent is allowed to easily reach for lotions etc while standing and remain attentive to baby. Thus, the hanging members are located in a more ergonomically suitable position while the user changes the baby.

The hanging members 108 protrude out from the backboard 160. The hanging members 108 may be integral with the backboard or may be a different material (such as aluminum or other kind of metal or a plastic different from the plastic of the backboard). The platform 102 may comprise notches 238 along the side walls 212 in which the hanging members 108 may be inserted when the platform 102 is placed in the vertical storage position, as seen in FIGS. 3A and 3B.

According to one embodiment, the two hanging members may have a maximum weight capacity of 15 pounds each and placed in an area above the platform but not above the working surface so that the items hanging on the hanging members are not directly above the baby. Furthermore, the location of the hanging members may be three to four inches from the edge of the platform or at least from the edge of the work surface of the platform. The top of the hanging members may be 17-18 inches above the edge of the work surface of the platform. Furthermore, the distance between the vertical wall and the inside surface of the hanging member may be at least two inches with a distance from the base of the hanging member (at the baseboard) to the top of the hanging member being at least two inches. However, it is noted that the hanging members may be any suitable configuration.

For example, FIG. 4A shows a hanging member 108A that comprises a circular rod 240A bent into a curve 244A at its distal end and a bulb 242A at its distal end. FIG. 4B shows a hanging member 108B that comprises a bent circular rod 240B that has a straight distal end 246B and a bulb 242B at its distal end. FIG. 41 shows a hanging member 1081 that comprises a flat straight aluminum rod 2401 bent upward at its distal end 248. Furthermore, the hanging members may project from any angle (such as 0°, 30°, 45°, 60°, 90° or any integer therebetween) from the surface of the backboard. Also, the hanging members may be projected from any surface of the backboard, such as the front surface 250 or a side surface 252 of the backboard.

Figure 19A:
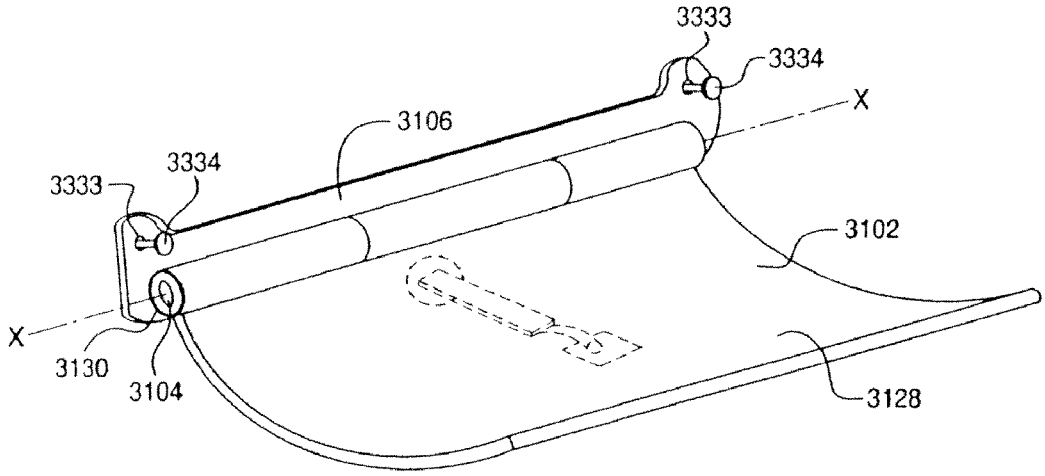
FIGS. 19A and 19B are frontal perspective and rear views, respectively, of a changing station according to an embodiment of the present invention.
Figure 19B:
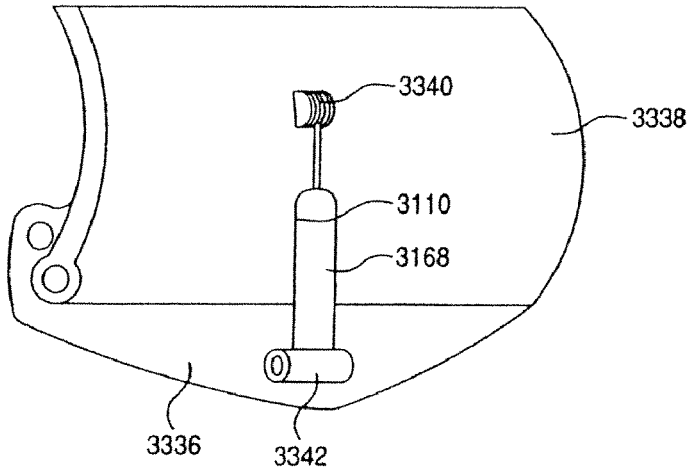

FIGS. 19A and 19B show vet another embodiment of a baby changing station according to the present invention. In this embodiment, the baby changing station may comprise a platform 3102, a support structure 3104, a mounting structure 3106, and a damper system 3110.

The platform 3102 is rotatable from a vertical storage position to a horizontal use position along a rotational axis X. It comprises a work surface 3128 on the upper surface of the platform which is curved so as to help retain the baby on the platform. The platform may be made of any suitable material such as stainless steel, steel, aluminum, plastic, etc. The support structure 3104 has a rotatable support member 3130 in the form of a hinge that rotates along the rotational axis X.

The mounting structure 3106 mounts the support structure 3104 to a vertical wall, and combine the functions of the backboard and the mounting brackets of the embodiment of FIG. 1 into a single structure. To mount the support structure on the wall, one or more holes 3333 are provided in which fasteners 3334 such as bolt, nails, or the like 3334 are fed through. The mounting structure also comprises a lower portion 3336, which extends below the platform 3102 when in the use position. The lower portion 3336 attaches to one end of the damper system 3110. The mounting portion may be formed of any suitable material such as stainless steel, steel, aluminum, plastic, etc.

The damper system 3110 is configured to slow the rotation of the platform 3102 when the platform 3102 moves from the vertical position to the horizontal position. It is attached at one end to the mounting structure 3106 and to the bottom surface 3338 of the platform 3102. The damper system may comprise a gas spring 3168, a first attachment portion 3340 and a second attachment portion 3342. The first attachment portion 3340 attaches to the bottom surface 3338 of the platform 3102 and the second attachment portion 3342 attaches to the mounting structure 3106.

The first attachment portion 3340 and the second attachment portion 3342 of the gas spring 3168 may be similar to the attachment portion 186 of the gas spring 168 of FIG. 8, which attaches to U-shaped brackets such as the bracket 178 of FIG. 8. The U-shaped brackets, in turn, are either integral with or attached to the mounting structure 3106 and the bottom surface 3338 of the platform, respectively.

With the embodiment of FIGS. 19A and 19B, the platform may begin in the vertical storage position (the closed position), as seen in FIG. 19B. As the platform is pulled down to the horizontal use position (the open position), the attachment portions 3340 and 3342 move closer together as the support member 3130 (the hinge) rotates. Eventually the cantilevered weight force of the platform overcomes the gas spring force and the platform begins to slowly fall to the open position. At the open position, the gas spring 3168 is fully compressed; thus the platform 3102 stops falling. In FIG. 19A, the platform is now in the open position with the gas spring 3168 fully compressed and the attachment portions of the gas spring are at their closest distance relative to each other. In this position, the gas spring may also provide additional support for the platform when in use.

As the platform 3102 is pulled up to the closed position, the locations of the attachment portions 3340 and 3342 move farther away from each other as the support member 3130 (the hinge) rotates, which causes the gas spring 3168 to extend as it rotates relative to the mounting bracket 3158. Eventually the force of the gas spring 3168 overcomes the cantilevered weight force and the platform begins to slowly rise to the closed position. At the closed position in FIG. 19B, the gas spring 3168 is fully extended preventing the platform from rotating any farther or the platform is prevented from rotating due to its contact with the vertical wall.

FIGS. 20A through 20C, 21A, 21B, and 22 show yet another embodiment of the baby changing station according to the present invention. The baby changing station 4100 of this embodiment may comprise a platform 4102, a support structure 4104, a mounting structure 4106, at least one hanging member 4108, and a damper system 4110.

Figure 20A:
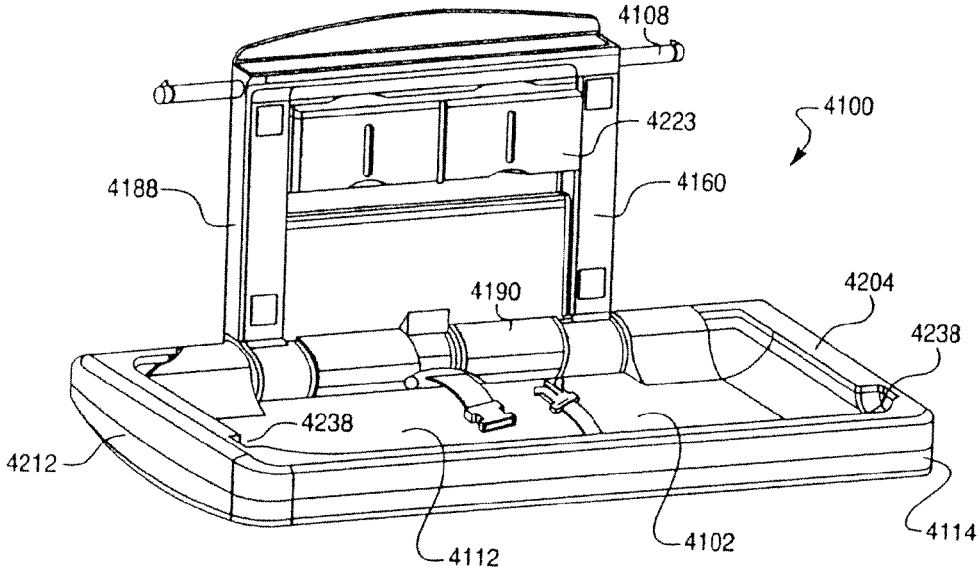
FIGS. 20A through 20C are open frontal perspective, close frontal perspective, and open rear perspective views, respectively, of a changing station according to an embodiment of the present invention.
Figure 20B:
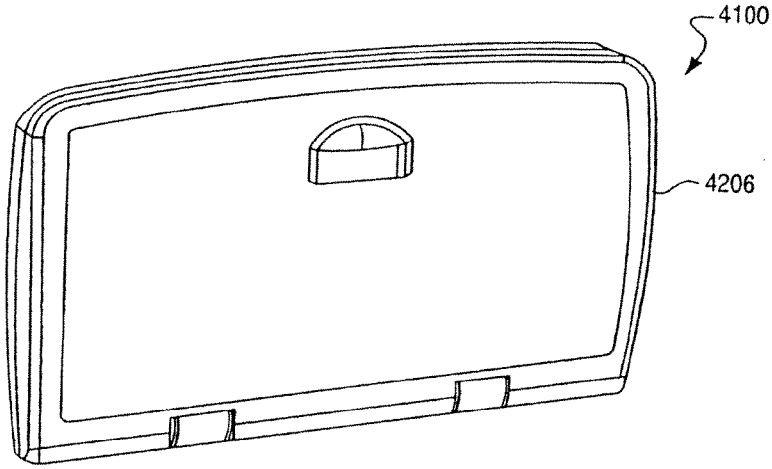

The platform 4102 can be rotatable from a vertical storage position, as seen in FIG. 20B, to a horizontal use position, as seen in FIG. 20A. The platform 4102 can be supported in the horizontal use position by one or more members of the support structure 4104. The platform may be made of any suitable material as previously described, and should be smooth or at least lightly textured so that it is easily cleaned. The platform could have corners 4114 with large radii to protect the user against injury and sidewalls 4212 around the periphery of the work surface 4112 so as to aid in retaining the baby on the work surface. The platform 4102 can include a top portion 4204 and a bottom portion 4206, which encapsulate the support structure. The inner surfaces of the top and bottom portions can contain a plurality of ribs that can run in a suitable pattern to accommodate the support structure that is located within the platform and to provide strength to the work surface 4112 so that the platform does not significantly deform under a work load.

Figure 20C:
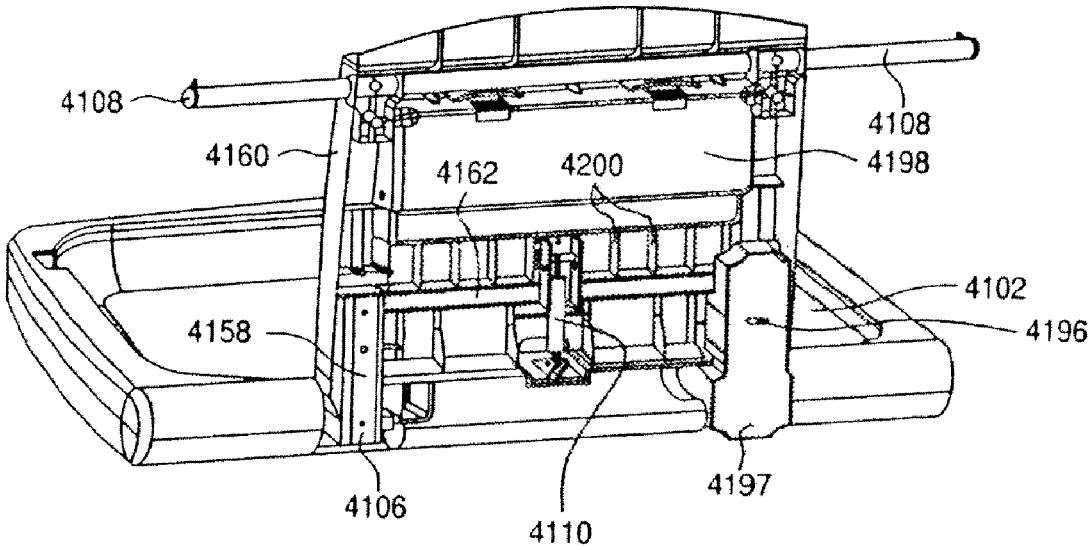
Figure 22:
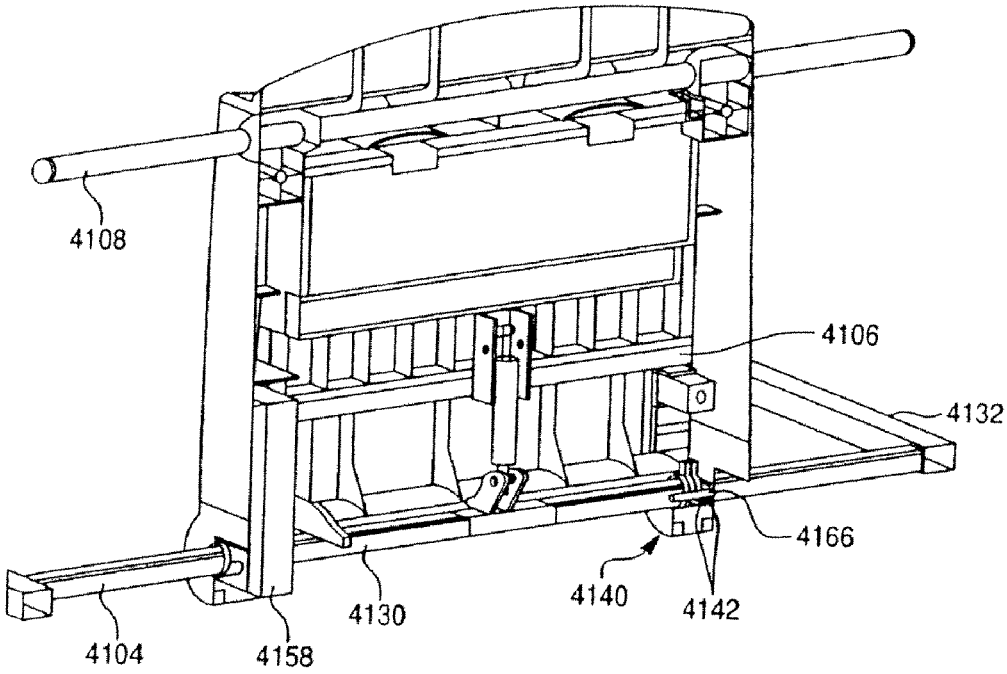
FIG. 22 is a rear perspective view of the changing station of FIGS. 20A through 20C with the platform removed to show the support structure.

The support structure 4104 of the embodiment of FIGS. 20A through 20C is shown in FIG. 22, and is similar to the support structure 104 of FIG. 2. The support structure should comprise with a rotatable support member 4130 that rotates and at least one, preferably two, extending members 4132 that extends out at an angle from the support member 4130 for supporting the platform 4102. The support member and extending members may be formed from any suitable material, but preferably formed of metal, such as steel or stainless steel. The support and extending members may be any suitable cross-section and/or length.

The support member is attached to the mounting structure 4106 at the rotatable joints 4140. One of the mounting brackets 4158 in FIG. 22 is removed so that the rotatable joint 4140 can be seen. Each rotatable joint may comprise two hinge stops 4142 that lie beside each other and a bearing in which each hinge stop is similar to the hinge stop of FIG. 7.

The mounting structure 4106 may mount the support structure 4104 to a vertical wall. The mounting structure 4106 may comprise mounting brackets 4158 covered by a backboard 4160, a central bracket 4162, and an open/close stop 4166. The support structure including the mounting brackets and central bracket and the damper system function and are structured in a similar fashion as in the embodiment of FIGS. 5A through 5C and 9A through 9C. Also, a cover 4197 may be used to cover the mounting brackets 4158 although one cover may be used over each mounting bracket. If a cover 4197 as seen in FIG. 20C is used, the cover may include a hole 4196 through which a fastener is fed through so as to attach the station to the vertical wall.

Referring back to FIGS. 20A, 20C, 21A, and 21B, the mounting structure 4106 also comprises a backboard 4160 that covers the mounting brackets 4158. The backboard may be formed of any suitable material, such as polypropylene plastic made using high-pressure injection molding technology or other suitable plastic (with or without anti-microbial additives). The backboard may comprise a base portion 4188, a hinge portion 4190, and two liner dispensers 4223. The base portion may have a smooth front surface, which is aesthetically pleasing to the public, and a back surface 4198 that is formed to accommodate the damper system 4110 and the rest of the mounting structure 4106. The back surface 4198 may include a plurality of ribs 4200 that run horizontally or vertically such that the components of the mounting structure 4106 and the damper system 4110 can be accommodated within the base portion 4188 while providing suitable reinforcement to inhibit or prevent buckling or deformation of the base portion.

The hinge portion 4190 of the backboard is attached to the base portion 4188 and covers the support member 4130 and the rotatable joints 4140. A cut-out 4202 in the platform 4102 accommodates the hinge portion 4190 of the backboard such that the platform may rotate upwards. The cut-out 4202 may be large enough to only permit the hinge portion 4190 to smoothly enter the cut-out during the rotation of the platform.

Figure 21A:
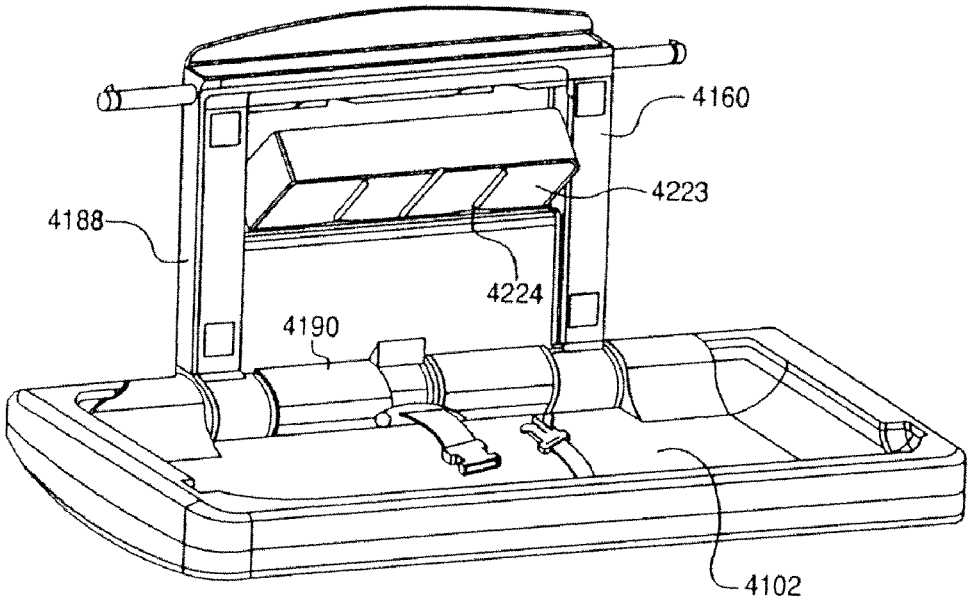
FIGS. 21A and 21B are frontal perspective views of the changing station of FIGS. 20A through 20C with the liner dispenser being open for refill.
Figure 21B:
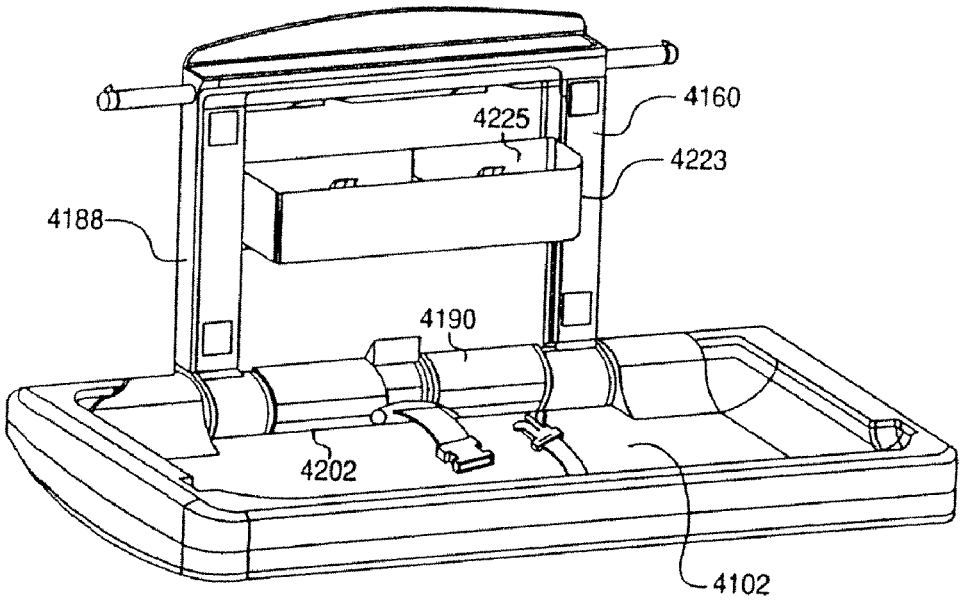

The liner dispensers 4223 contain paper bed liners (which can be sheets of large tissue paper). In one example, each dispenser may be able to hold a minimum of 40 liners. The dispenser is pivotable around its base portion so that it can be refilled. FIG. 21A shows the rotation of the dispensers 4223 when they are half-opened while FIG. 21B shows the rotation of the dispensers when they are fully open. As can be seen, each dispenser includes an opening 4224 at its front end so that the liner can be dispensed and an opening 4225 at its back end so that it may be refilled when it is tilted forward.

The baby changing station of FIG. 20A may also include at least one hanging member 4108 located on the backboard 4160. In a preferred embodiment, there may be at least two hanging members. The at least one hanging member 4108 is located on the backboard 4160 of the mounting structure 4106 such that the hanging member 4108 is spaced at a vertical distance from the platform 4102 when the platform 4102 is in the horizontal position. The hanging member(s) can be configured to be used, for example, as hangers or hooks for diaper bag handles. The hanging members 4108 of FIG. 20A protrude out from the backboard 4160 in a straight fashion, and may be integral with the backboard or may be a different material (such as aluminum or other kind of metal or a plastic different from the plastic of the backboard). The platform 4102 may comprise notches 4238 along the side walls 4212 in which the hanging members 4108 may be inserted when the platform 4102 is placed in the vertical storage position.

FIGS. 23A through 23C, 24A, 24B, and 25 show yet another embodiment of the baby changing station according to the present invention. This embodiment is similar to the embodiment shown in FIGS. 20A through 20C, 21A, 21B, and 22 except this configuration is a vertical baby changing station while the embodiment of FIGS. 20A through 20C, 21A, 21B, and 22 is a horizontal baby changing station. The baby changing station 5100 of this embodiment may comprise a platform 5102, a support structure 5104, a mounting structure 5106, at least one hanging member 5108, and a damper system 5110.

Figure 23B:
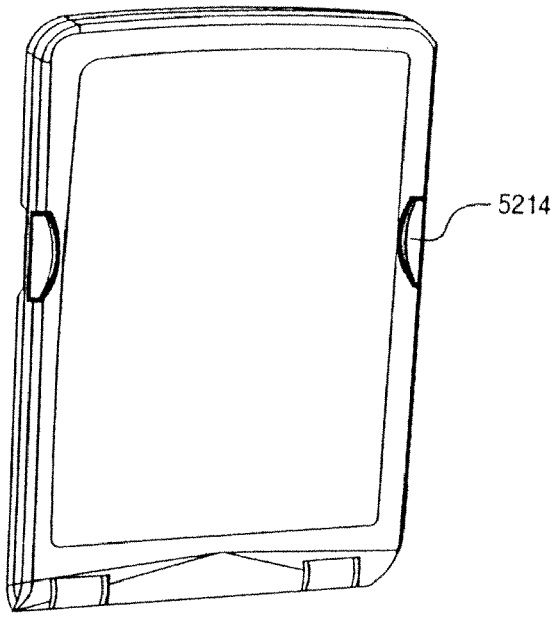
FIGS. 23A through 23C are open frontal perspective, close frontal perspective, and close rear views, respectively, of a changing station according to an embodiment of the present invention.
Figure 23A:
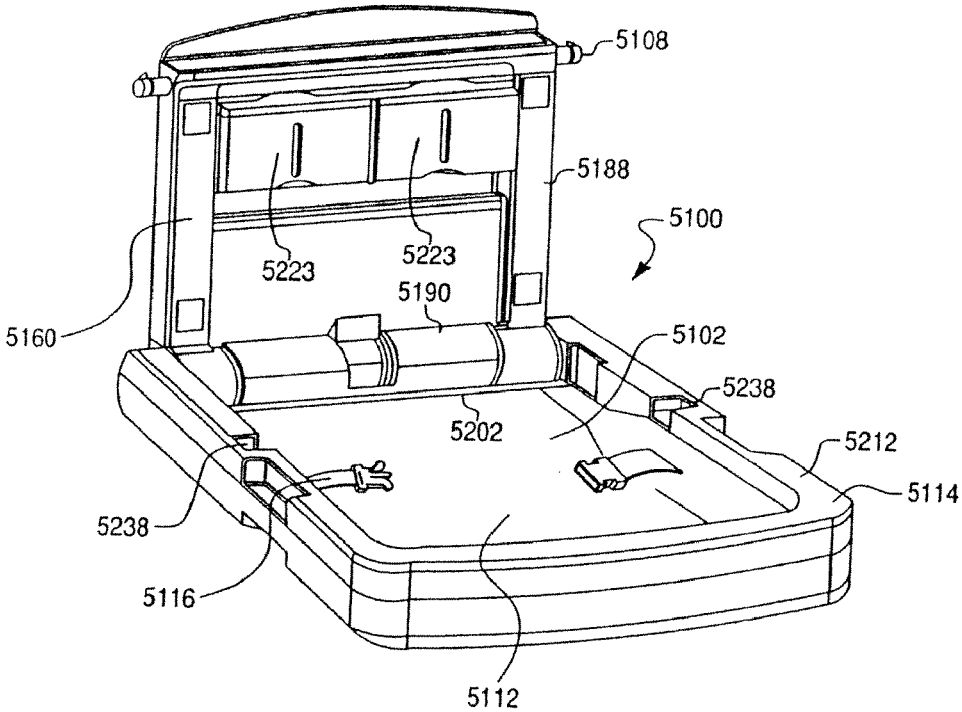

The platform 5102 can be rotatable from a vertical storage position, as seen in FIG. 23B, to a horizontal use position, as seen in FIG. 23A. The platform 5102 can be supported in the horizontal use position by one or more members of the support structure 5104. The platform may be made of any suitable material as previously described, and should be smooth or at least lightly textured so that it is easily cleaned. The platform could have corners 5114 with large radii to protect the user against injury and sidewalls 5212 around the periphery of the work surface 5112 so as to aid in retaining the baby on the work surface. The platform 5102 can include a top portion and a bottom portion, which encapsulate the support structure. The inner surfaces of the top and bottom portions can contain a plurality of ribs that can run in a suitable pattern to accommodate the support structure that is located within the platform and to provide strength to the work surface 5112 so that the platform does not significantly deform under a work load.

Figure 23C:
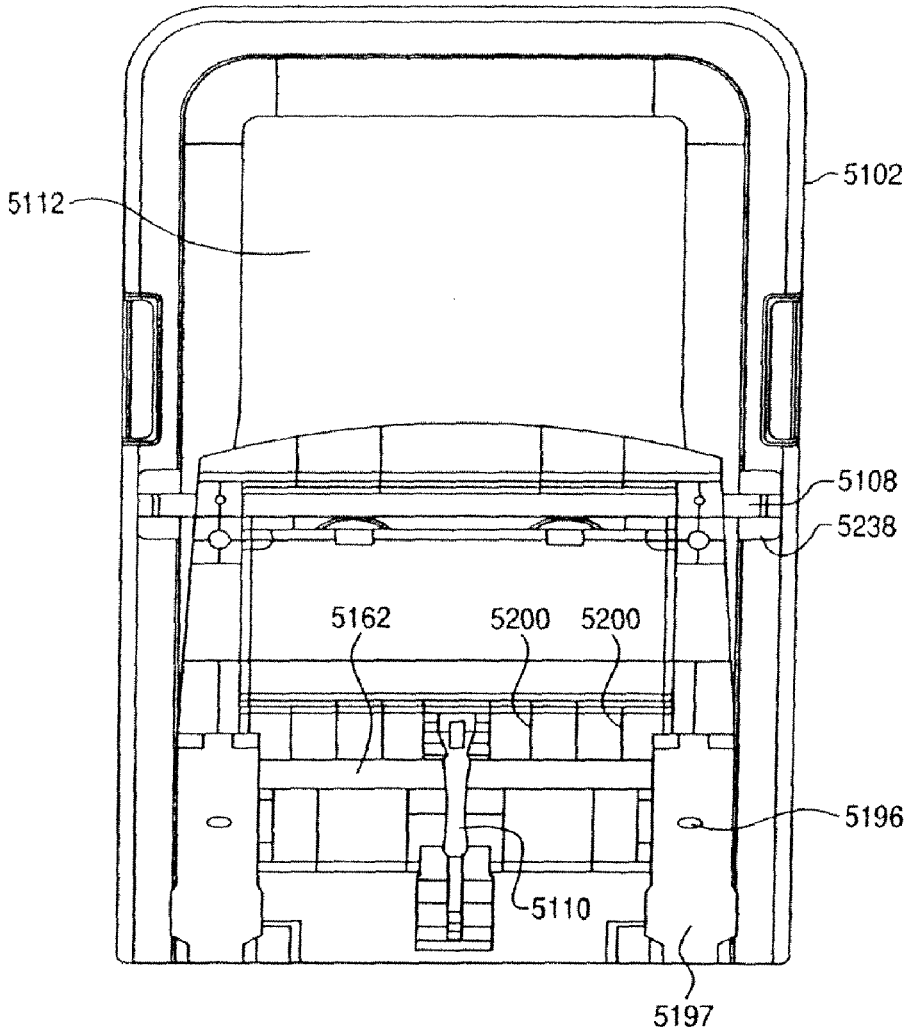
Figure 24A:
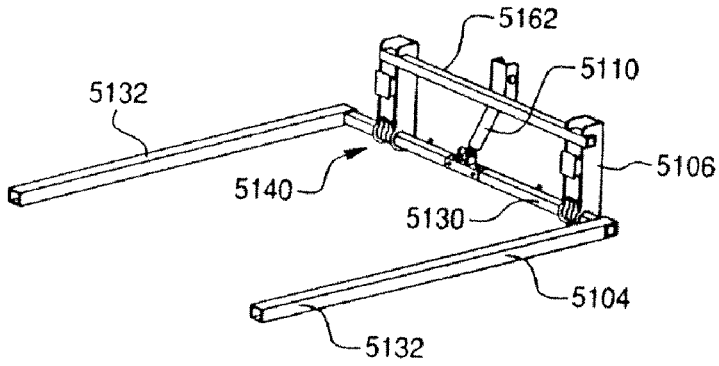
FIGS. 24A and 24B are frontal perspective and rear perspective views of the mounting structure and damper system of the changing station of FIGS. 23A through 23C.
Figure 24B:
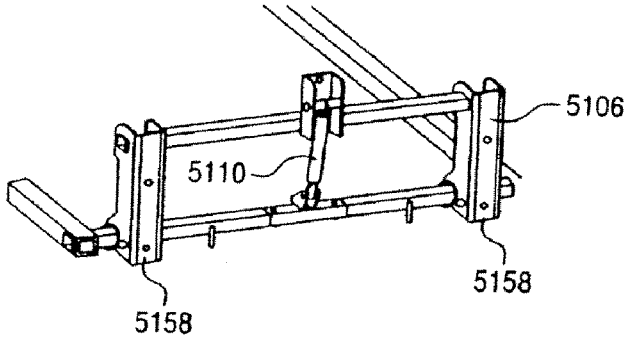
Figure 25:
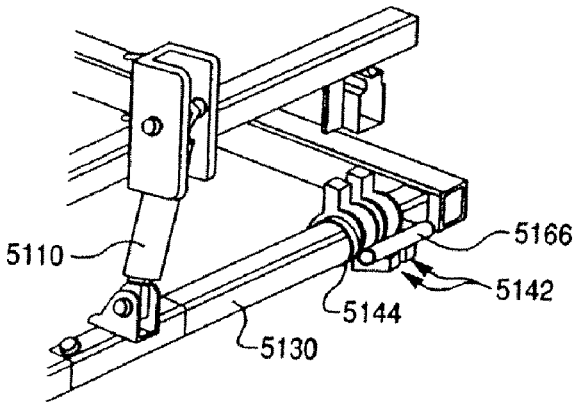
FIG. 25 is a rear perspective view of the damper system of FIGS. 24A and 24B.

The support structure 5104 of the embodiment of FIGS. 23A through 23C is shown in FIGS. 24A, 24B, and 25, and is similar to the support structure 104 of FIG. 2 with a rotatable support member 5130 that rotates and at least one, preferably two, extending members 5132 that extends out at an angle from the support member 5130 for supporting the platform 5102. The support member and extending members may be formed from any suitable material, but preferably formed of metal, such as steel or stainless steel. The support and extending members may be any suitable cross-section and/or length. The support member is attached to the mounting structure 5106 at rotatable joints 5140. Each rotatable joint may comprise two hinge stops 5142 that lie beside each other and a bearing 5144 in which each hinge stop is similar to the hinge stop of FIG. 7.

The mounting structure 5106 may mount the support structure 5104 to a vertical wall. The mounting structure 5106 may comprise mounting brackets 5158 covered by a backboard 5160, a central bracket 5162, and an open/close stop 5166. The support structure including the mounting brackets and central bracket and the damper system function and are structured in a similar fashion as in the embodiment of FIGS. 5A through 5C and 9A through 9C. Also, covers 5197 shown in FIG. 23C may be used to cover the mounting brackets 5158, which may include a hole 5196 through which a fastener is fed through so as to attach the station to the vertical wall.

Referring back to FIGS. 23A through 23C, the mounting structure 5106 also comprises a backboard 5160 that covers the mounting brackets 5158. The backboard may be formed of any suitable material, such as polypropylene plastic made using high-pressure injection molding technology or other suitable plastic (with or without anti-microbial additives). The backboard may comprise a base portion 5188, a hinge portion 5190, and two liner dispensers 5223. The base portion may have a smooth front surface, which is aesthetically pleasing to the public, and a back surface that is formed to accommodate the damper system 5110 and the rest of the mounting structure 5106. The back surface 5198 may include a plurality of ribs 5200 that run horizontally or vertically such that the components of the mounting structure 5106 and the damper system 5110 can be accommodated within the base portion 5188 while providing suitable reinforcement to inhibit or prevent buckling or deformation of the base portion.

The hinge portion 5190 of the backboard is attached to the base portion 5188 and covers the support member 5130 and the rotatable joints 5140. A cut-out 5202 in the platform 5102 accommodates the hinge portion 5190 of the backboard such that the platform may rotate upwards. The cut-out 5202 may be large enough to only permit the hinge portion 5190 to smoothly enter the cut-out during the rotation of the platform.

The liner dispensers 5223 contain paper bed liners (which can be sheets of large tissue paper). In one example, each dispenser may be able to hold a minimum of 40 liners. The dispensers are pivotable around their base portion so that they can be refilled in a manner to the rotating operation shown in FIG. 21A and FIG. 21B. Each dispenser includes an opening at its front end so that the liner can be dispensed and an opening at its back end so that it may be refilled when it is tilted forward.

The baby changing station of FIG. 23A may also include at least one hanging member 5108 located on the backboard 5160. In a preferred embodiment, there may be at least two hanging members. The at least one hanging member 5108 is located on the backboard 5160 of the mounting structure 5106 such that the hanging member 5108 is spaced at a vertical distance from the platform 5102 when the platform 5102 is in the horizontal position. The hanging member(s) can be configured to be used, for example, as hangers or hooks for diaper bag handles. The hanging members 5108 of FIG. 23A protrude out from the backboard 5160 in a straight fashion, and may be integral with the backboard or may be a different material (such as aluminum or other kind of metal or a plastic different from the plastic of the backboard). The platform 5102 may comprise notches 5238 along the side walls 5212 in which the hanging members 5108 may be inserted when the platform 5102 is placed in the vertical storage position, as seen in FIG. 23C.

Furthermore, the platform 5102 also includes slots in which safety straps 5116 are fed through so as to secure the baby to the work surface and/or handles 5214 for opening the baby station from its vertical position to its horizontal position.

Given the various embodiments disclosed above and shown in the Figures, it is contemplated that various aspects of the different embodiments may be transferable to other embodiments; thus the features of each embodiment is transferable to other embodiments.

With the above-disclosure, various embodiments of the baby changing station are disclosed, which are particularly useful to parents who must use baby changing stations on the go typically have many items that are carried in-hand, with baby, such as diaper bags, purses, shopping bags, etc. The baby changing station according to embodiments of the present invention have been developed to provide a cost effective solution with sturdiness, antimicrobial-plastic, and additional features. The above-described embodiments may make use of common components (such as steel and plastic), which can achieve a lower piece price per component. Furthermore, the embodiments of the present invention may be compliant with all applicable global baby changing station standards, such as ASTM, ADA, and EN (European Norm).

Given the disclosure of the present invention, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A changing station for supporting a small person, the changing station comprising:

a platform that is rotatable from a vertical storage position to a horizontal use position along a rotational axis, the platform comprising a top portion and a bottom portion;

a support structure having a rotatable support member that is rotatable along the rotational axis, and two extending members extending out at an angle from the support member and encapsulated between the top and bottom portions of the platform, the rotatable support member comprising an elongate tube and the rotational axis being a central longitudinal axis of the elongate tube;

a mounting structure for mounting the support structure to a vertical surface, the mounting structure comprising a pair of spaced apart mounting brackets and a central bracket, wherein the central bracket is spaced from the rotatable support member and extends between the mounting brackets;

a pair of open/close stops mounted to the mounting structure; and a pair of hinge stops mounted to the rotatable support member at a location spaced inwardly between the two extending members, each hinge stop having at least one surface extending away from the elongate tube in a radially outward direction such that the at least one surface of each hinge stop engages a respective one of the pair of open/close stops for controlling the rotation of the rotatable support member at least when the platform is in the horizontal use position.

2. The changing station of claim 1, further comprising at least one damper system configured to slow the rotation of the platform when the platform moves from the vertical storage position to the horizontal use position.

3. The changing station of claim 2, wherein the damper system comprises at least one gas spring attached between the rotatable support member and the central bracket of the mounting structure.

4. The changing station of claim 3, wherein the gas spring compresses as the platform is moved from the vertical storage position to the horizontal use position, and extends when the platform is moved from the horizontal use position to the vertical storage position.

5. The changing station of claim 1, wherein the platform is constructed of a plastic and the support structure is constructed of a metal.

6. The changing station of claim 1, wherein each hinge stop includes a cut-out that aligns with a cross-section of the elongate tube of the support member.

7. The changing station of claim 1, wherein the mounting brackets of the mounting structure are spaced inwardly between the two extending arms of the support structure.

* * * * *